US007699418B2

(12) United States Patent
Gao et al.

(10) Patent No.: US 7,699,418 B2
(45) Date of Patent: Apr. 20, 2010

(54) LIQUID JETTING APPARATUS AND LIQUID JETTING METHOD

(75) Inventors: Yue Gao, Nagano-ken (JP); Katsuhiro Okubo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 61 days.

(21) Appl. No.: 11/868,319

(22) Filed: Oct. 5, 2007

(65) Prior Publication Data

US 2008/0030531 A1 Feb. 7, 2008

Related U.S. Application Data

(62) Division of application No. 11/081,810, filed on Mar. 17, 2005, now Pat. No. 7,467,835.

(30) Foreign Application Priority Data

Mar. 17, 2004 (JP) ..... 2004-076891
Mar. 23, 2004 (JP) ..... 2004-085586

(51) Int. Cl.
*B41J 25/308* (2006.01)
*B41J 29/38* (2006.01)
*B41J 29/393* (2006.01)

(52) U.S. Cl. ..... 347/8; 347/9; 347/19

(58) Field of Classification Search ..... 347/8, 347/9, 19

See application file for complete search history.

(56) References Cited

U.S. PATENT DOCUMENTS

2004/0075704 A1 4/2004 Takano et al.

FOREIGN PATENT DOCUMENTS

JP 2003-53968 A 2/2003
JP 2003-326716 A 11/2003

*Primary Examiner*—Matthew Luu
*Assistant Examiner*—Jannelle M Lebron
(74) *Attorney, Agent, or Firm*—Sughrue Mion, PLLC

(57) ABSTRACT

A liquid jetting apparatus and a liquid jetting method are achieved that can prevent unexpected landing position displacement relating to satellite droplets. For example, the liquid jetting apparatus includes a head in which a nozzle row constituted by a plurality of nozzles lined up in a row is arranged at a medium-opposing surface which is in opposition to a medium, a head movement section that moves the head in a predetermined direction along a surface of the medium, a spacing adjustment section that adjusts a spacing between the head and the medium, and an ejection control section that carries out ejection control of a liquid by determining at least one non-ejection nozzle among a plurality of nozzles sandwiched between a nozzle at one end of the nozzle row and a nozzle at another end thereof, the non-ejection nozzle being a nozzle which is caused not to eject liquid, the number of the non-ejection nozzle being determined according to a spacing from the medium-opposing surface to the surface of the medium.

5 Claims, 25 Drawing Sheets

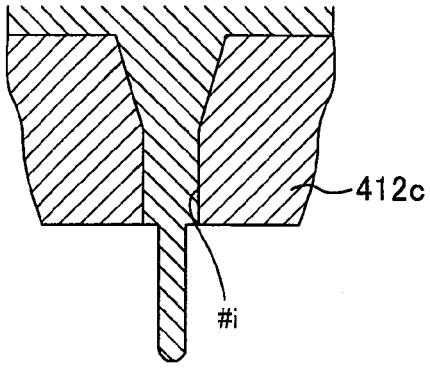
Fig.14A
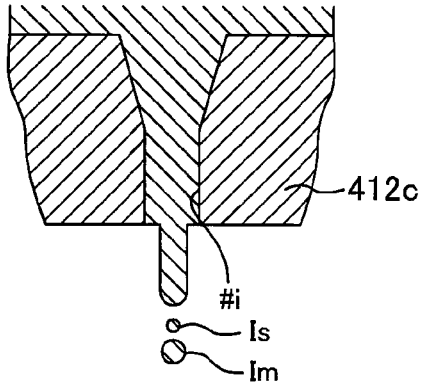
Fig.14B
Fig.15A
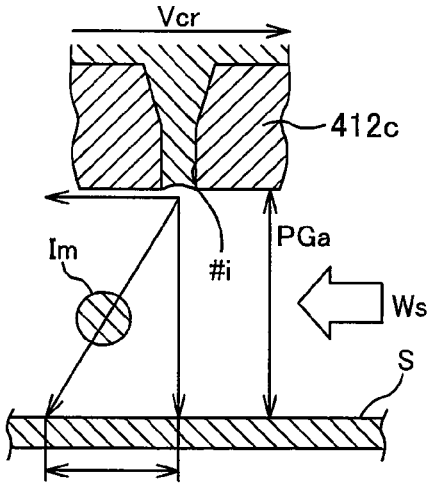
Fig.15B
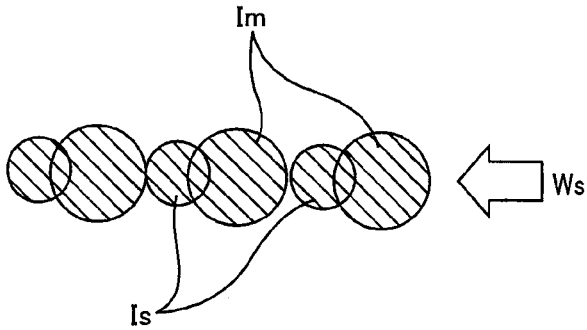

| STATE OF HEAD POSITION DETECTION SENSOR | HEAD HEIGHT DIRECTION POSITION | SPACING FROM PAPER-OPPOSING SURFACE TO PLATEN SURFACE |
|---|---|---|
| OFF | LOW | 1.5mm |
| ON | HIGH | 2.0mm |

Fig.22

| PAPER TYPE | PAPER THICKNESS |
|---|---|
| NORMAL PAPER | 0.1mm |
| GLOSSY PAPER | 0.23mm |
| PHOTO PAPER | 0.27mm |

Fig.23

| IMAGE QUALITY | PRINT MODE |
|---|---|
| NORMAL | HIGH SPEED (EJECTION FREQUENCY=14.4kHz, MOVEMENT VELOCITY=HIGH SPEED) |
| FINE | HIGH IMAGE QUALITY (EJECTION FREQUENCY=7.2kHz, MOVEMENT VELOCITY=LOW SPEED) |

Fig.24

NORMAL MODE

| SPACING FROM PAPER-OPPOSING SURFACE TO PAPER SURFACE | NUMBER OF CONSECUTIVE NOZZLES |
|---|---|
| LESS THAN 1.0mm | NO LIMIT (180) |
| 1.0mm OR MORE, LESS THAN 1.5mm | NO LIMIT (180) |
| 1.5mm OR MORE | 30 |
| CARRIAGE MOVEMENT VELOCITY: 300cps, DRIVE FREQUENCY: 14.4kHz, NOZZLE RESOLUTION: 180dpi | |

Fig.29A

FINE MODE

| SPACING FROM PAPER-OPPOSING SURFACE TO PAPER SURFACE | NUMBER OF CONSECUTIVE NOZZLES |
|---|---|
| LESS THAN 1.0mm | NO LIMIT (180) |
| 1.0mm OR MORE, LESS THAN 1.5mm | NO LIMIT (180) |
| 1.5mm OR MORE | NO LIMIT (180) |
| CARRIAGE MOVEMENT VELOCITY: 185cps, DRIVE FREQUENCY: 7.7kHz, NOZZLE RESOLUTION: 180dpi | |

Fig.29B

NORMAL MODE

| SPACING FROM PAPER-OPPOSING SURFACE TO PAPER SURFACE | NUMBER OF CONSECUTIVE NOZZLES |
|---|---|
| LESS THAN 1.0mm | NO LIMIT (180) |
| 1.0 mm OR MORE, LESS THAN 1.5 mm | 85 |
| 1.5 mm OR MORE | 30 |
| CARRIAGE MOVEMENT VELOCITY: 300cps, DRIVE FREQUENCY: 14.4kHz, NOZZLE RESOLUTION:180dpi | |

Fig.31

NORMAL MODE

| SPACING FROM PAPER-OPPOSING SURFACE TO PAPER SURFACE | INK EJECTION FREQUENCY | | |
|---|---|---|---|
| | LOW FREQUENCY | MEDIUM FREQUENCY | HIGH FREQUENCY |
| LESS THAN 1.0mm | NO LIMIT | NO LIMIT | NO LIMIT |
| 1.0mm OR MORE, LESS THAN 1.5mm | NO LIMIT | 85 | 55 |
| 1.5mm OR MORE | NO LIMIT | 55 | 30 |
| CARRIAGE MOVEMENT VELOCITY: 300cps, DRIVE FREQUENCY: 14.4kHz, NOZZLE RESOLUTION: 180dpi | | | |

Fig.32

NORMAL MODE

| SPACING FROM PAPER-OPPOSING SURFACE TO PAPER SURFACE | NUMBER OF CONSECUTIVE NON-EJECTION NOZZLES (COEFFICIENT WITH RESPECT TO A REFERENCE VALUE) |
|---|---|
| LESS THAN 1.0 mm | — |
| 1.0 mm OR MORE, LESS THAN 1.5 mm | 0.5 |
| 1.5 mm OR MORE | — |

Fig.33

LIQUID JETTING APPARATUS AND LIQUID JETTING METHOD

CROSS-REFERENCE TO RELATED APPLICATIONS

This is a divisional of application Ser. No. 11/081,810 filed Mar. 17, 2005. Priority is claimed from Japanese Patent Application No. 2004-076891 filed on Mar. 17, 2004, and Japanese Patent Application No. 2004-085586 filed on Mar. 23, 2004. The entire disclosure of the prior application, application Ser. No. 11/081,810, and the above-identified priority documents are herein incorporated by reference.

BACKGROUND OF THE INVENTION

1. Field of the Invention

The present invention relates to liquid jetting apparatuses and liquid jetting methods.

2. Description of the Related Art

A liquid jetting apparatus is an apparatus to eject a liquid. The liquid jetting apparatuses include apparatuses such as printing apparatuses, color filter manufacturing apparatuses, and dying apparatuses. These liquid jetting apparatuses are provided with a head to eject a liquid. This head is made to eject the liquid toward a medium while being moved in a predetermined direction along a surface of the medium. For this reason, nozzles, which are ejection openings for the liquid, are provided on a medium opposing surface of the head. Furthermore, in order to eject a large amount of liquid in a short time, the nozzles are lined up in a row and configured in nozzle rows.

With this type of liquid jetting apparatus, it is required for the process of ejecting liquid to be shortened. For this reason, there is a tendency for the number of nozzles in each nozzle row to increase in relation to the head. For example, a head in which there are 180 nozzles per nozzle row has been proposed (see JP 2003-53968A, for example). If these nozzles are provided at a pitch corresponding to 180 dpi temporarily, then the length of the nozzle row is one inch (2.54 cm). There is also required greater speed in relation to the ejection frequency of the liquid (see JP 2003-326716A, for example). With these liquid jetting apparatuses, the movement speed of the head is increased along with increase in ejection frequencies of liquid.

With this type of liquid jetting apparatus, it is known that the droplets ejected from the nozzles separate and fly as main droplets and satellite droplets. In conventional apparatuses, the flight trajectory of the main droplets and the flight trajectory of the satellite droplets have a substantially fixed relationship, and the amount of displacement between the landing positions of both of these droplets is substantially fixed. For this reason, control of ejection that takes into account the displacement of the landing positions has been possible.

However, due to the above-mentioned increase in the number of nozzles per nozzle row, increased frequency of liquid ejection, and increased movement speed of the head, the satellite droplets fly greatly displaced from ordinary flight trajectories, and a phenomenon has been confirmed in which unexpected displacement in landing positions is caused. This unexpected displacement in landing position is a cause of various problems. For example, it is a cause of unevenness in color in printing apparatuses and textile printing apparatuses. It is also a cause of color mixing in color filter manufacturing apparatuses.

SUMMARY OF THE INVENTION

The present invention was arrived at in light of the foregoing issues, and it is an object thereof to achieve a liquid jetting apparatus and a liquid jetting method which can prevent unexpected landing position displacement relating to satellite droplets.

A primary aspect of the invention for achieving the foregoing object is a liquid jetting apparatus comprising:

a head in which a nozzle row constituted by a plurality of nozzles lined up in a row is arranged on a medium-opposing surface which is in opposition to a medium, a head movement section that moves the head in a predetermined direction along a surface of the medium, a spacing adjustment section that adjusts a spacing between the head and the medium, and an ejection control section that carries out ejection control of a liquid by determining at least one non-ejection nozzle among a plurality of nozzles sandwiched between a nozzle at one end of the nozzle row and a nozzle at another end thereof, the non-ejection nozzle being a nozzle which is caused not to eject liquid, the number of the non-ejection nozzle being determined according to a spacing from the medium-opposing surface to the surface of the medium.

Features and objects of the present invention other than the above will be made clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings.

FIG. 14A is a diagram describing a formation process of ink droplets, and describing a state in which ink stretches into a column shape.

FIG. 14B is a diagram describing the formation process of ink droplets, and describing a state in which the ink droplets are formed.

FIG. 15A is a diagram schematically showing the flight trajectory of an ink droplet.

FIG. 15B is a diagram schematically showing landing position displacement of main ink droplets and satellite ink droplets, and shows landing position displacement which occurs ordinarily.

FIG. 22 is a diagram describing a table of information indicating a relationship of the state of a head position detection sensor, the position in the height direction of the head, and the spacing from the paper-opposing surface to the platen surface.

FIG. 23 is a diagram describing a table of information indicating a relationship between paper type and paper thickness.

FIG. 24 is a diagram describing a table of information indicating a relationship between image quality and print modes.

FIG. 29A is a diagram describing conditions for control in normal mode.

FIG. 29B is a diagram describing conditions for control in fine mode.

FIG. 31 is a diagram describing conditions when setting a number of consecutive nozzles according to the spacing between the paper-opposing surface and the paper surface.

FIG. 32 is a diagram describing conditions when setting a number of consecutive nozzles according to the ejection frequency of ink droplets.

FIG. 33 is a diagram describing conditions when setting a number of consecutive non-ejection nozzles according to the spacing between the paper-opposing surface and the paper surface.

DETAILED DESCRIPTION OF THE INVENTION

Figure 1:
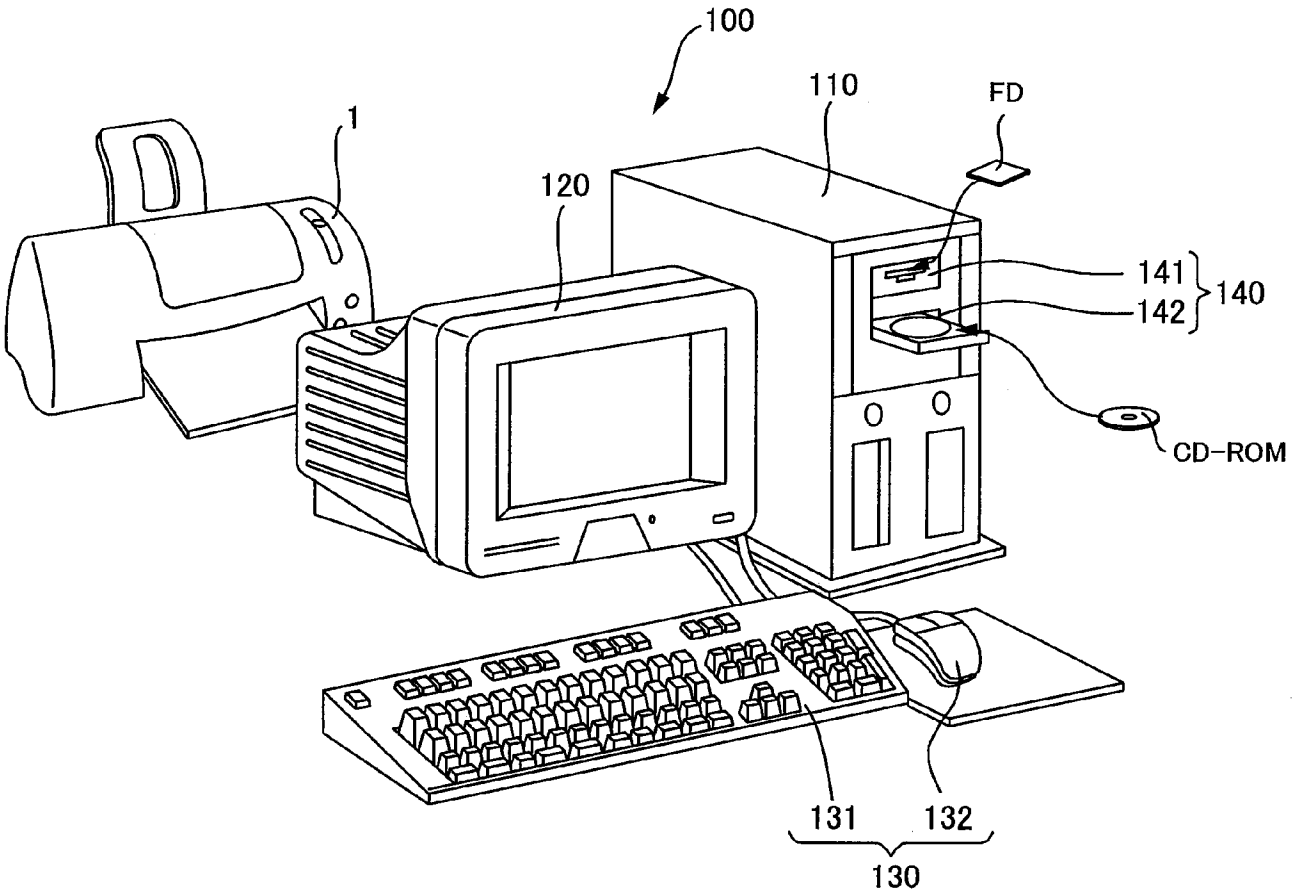
FIG. 1 is a diagram showing the overall configuration of a printing system.

At least the following matters will be made clear by the explanation in the present specification and the description of the accompanying drawings.

The following liquid jetting apparatus can be achieved.

A liquid jetting apparatus comprising:

a head in which a nozzle row constituted by a plurality of nozzles lined up in a row is arranged on a medium-opposing surface which is in opposition to a medium, a head movement section that moves the head in a predetermined direction along a surface of the medium, a spacing adjustment section that adjusts a spacing between the head and the medium, and an ejection control section that carries out ejection control of a liquid by determining at least one non-ejection nozzle among a plurality of nozzles sandwiched between a nozzle at one end of said nozzle row and a nozzle at another end thereof, said non-ejection nozzle being a nozzle which is caused not to eject liquid, the number of said non-ejection nozzle being determined according to a spacing from said medium-opposing surface to the surface of said medium.

With this liquid jetting apparatus, the portions of non-ejection nozzles in the nozzle row become more like the state in which the spacing between neighboring nozzles is wider than in other portions of the nozzle row. Thus, at the time of ejecting liquid, an air flow in a direction toward the medium is produced accompanying the ejection of the liquid, but for the portions corresponding to the non-ejection nozzles, the air flow is weaker than for the other portions or does not occur. In this way, the air flow produced accompanying the movement of the head in the predetermined direction, that is, the air flow along the surface of the medium passes through the portions corresponding to the non-ejection nozzles. Accordingly, the air flow along the surface of the medium becomes less easily affected by the air flow in a direction toward the medium and flows smoothly. As a result, it is possible to prevent unexpected landing position displacement relating to the satellite droplets.

It is preferable that the ejection control section determines the non-ejection nozzle for every predetermined number of nozzles.

With this liquid jetting apparatus, the areas in which the airflow in a direction toward the medium is weak, or the areas in which this flow is not produced, are created at constant intervals. That is, the areas in which air passes along the surface of the medium are formed for constant intervals. In this way, it is possible to effectively use all the plurality of nozzles of the nozzle row.

It is preferable that the non-ejection nozzle is made of a plurality of adjacent nozzles.

With this liquid jetting apparatus, it is possible to adjust the width of the areas in which the airflow passes through along the surface of the medium. Thus, it is possible to achieve an optimal arrangement of non-ejection nozzles for the liquid jetting apparatus.

It is preferable that, the number of the plurality of adjacent nozzles is determined according to the predetermined number of nozzles.

With this liquid jetting apparatus, the number of predetermined nozzles corresponds to the number of consecutive nozzles which can eject liquid. Thus, it is possible to match the width of the areas through which the airflow passes along the surface of the medium, to the number of nozzles which can eject liquid.

It is preferable that the ejection control section determines the number of the non-ejection nozzle according to an ejection frequency of the liquid.

With this liquid jetting apparatus, the strength of the airflow in a direction toward the medium varies according to the ejection frequency of the liquid, but it is possible to correspond to this variation.

It is preferable that the ejection control section obtains the spacing from the medium-opposing surface to the surface of the medium based on information relating to a spacing from a surface of the medium placing section on which the medium is placed to the medium-opposing surface, and information relating to a thickness of the medium.

With this liquid jetting apparatus, since the spacing from the medium-opposing surface to the surface of the medium is obtained based on information relating to a spacing from a surface of the medium placing section which can be obtained easily from the apparatus side to the medium-opposing surface, and information relating to the thickness of the medium which is determined by the type of media to be used, no dedicated measuring section is required to be provide for measuring the spacing from the medium-opposing surface to the surface of the medium. Thus, a reduction in the number of components is achieved.

It is preferable that the spacing adjustment section is another head movement section that moves the head in a direction approaching the medium and in a direction away from the medium, and the information relating to the spacing from the surface of the medium placing section to the medium-opposing surface is information indicating a position of the head determined using the other head movement section.

With this liquid jetting apparatus, the spacing from the medium-opposing surface of the head to the surface of the medium can be obtained based on information indicating the position of the head. Since the head can be moved easily compared to the medium placing section, structural simplification can be achieved.

It is preferable that the information relating to the thickness of the medium is information indicating a type of the medium.

With this liquid jetting apparatus, since information of the type of medium which is used when determining the ejection frequency of the liquid or the like, is used as information relating to the thickness of the medium, it is possible to reduce the types of information to be inputted.

It is apparent that the following liquid jetting apparatus can also be achieved.

A liquid jetting apparatus comprising:

a head in which a nozzle row constituted by a plurality of nozzles lined up in a row is arranged on a medium-opposing surface which is in opposition to a medium, a head movement section that moves the head in a predetermined direction along a surface of the medium, a medium placing section on which the medium is placed, a spacing adjustment section that adjusts a spacing between the head and the medium, and an ejection control section that carries out ejection control of a liquid by obtaining a spacing from the medium-opposing surface to the surface of the medium based on information relating to a spacing from a surface of the medium placing section to the medium-opposing surface and information relating to a thickness of the medium, and determining at least one non-ejection nozzle among a plurality of nozzles sandwiched between a nozzle at one end of the nozzle row and a nozzle at another end thereof, the non-ejection nozzle being a nozzle which is caused not to eject liquid, the non-ejection nozzle being made of a plurality of adjacent nozzles, the non-ejection nozzle being determined for every predetermined number of nozzles, the number of the non-ejection nozzle being determined according to the spacing from the medium-opposing surface to the surface of the medium, an ejection frequency of the liquid, and the predetermined number of nozzles, wherein the spacing adjustment section is another head movement section that moves the head in a direction approaching the medium and in a direction away from the medium, wherein the information relating to the spacing from the surface of the medium placing section to the medium-opposing surface is information indicating a position of the head determined using the other head movement section, and wherein the information relating to the thickness of the medium is information indicating a type of the medium.

Next, it is apparent that the following liquid jetting apparatus can also be achieved.

A liquid jetting apparatus comprising:

a head in which a plurality of nozzles lined up in a row are provided in a medium-opposing surface which is in opposition to a medium, a head movement section that moves the head in a predetermined direction along a surface of the medium, a spacing adjustment section that adjusts a spacing between the head and the medium, and an ejection control section that carries out ejection control of a liquid by limiting the number of consecutive nozzles which are allowed to eject the liquid simultaneously according to a spacing from the medium-opposing surface to the surface of the medium.

With this liquid jetting apparatus, the number of consecutive nozzles which can eject liquid simultaneously is limited, and therefore the airflow produced accompanying movement of the head in the predetermined direction that flows along the medium surface goes around the sides of the airflow in a direction toward the medium produced accompanying ejection of the liquid. This enables the air that flows along the medium surface to flow smoothly, and prevents turbulence thereof. In this way, it is possible to prevent unexpected landing position displacement relating to the satellite droplets.

It is preferable that the ejection control section makes the number of the consecutive nozzles smaller as the spacing from the medium-opposing surface to the surface of the medium becomes wider.

With this liquid jetting apparatus, it is possible to set the consecutive nozzles which can eject liquid simultaneously to a number suitable for the spacing from the medium-opposing surface to the surface of the medium.

It is preferable that the ejection control section limits the number of the consecutive nozzles according to an ejection frequency of the liquid.

With this liquid jetting apparatus, it is possible to set the consecutive nozzles which can eject liquid simultaneously to a number suitable for the strength of the airflow in a direction toward the medium.

It is preferable that the ejection control section makes the number of the consecutive nozzles smaller as the ejection frequency of the liquid becomes higher.

With this liquid jetting apparatus, it is possible to reliably prevent unexpected landing position displacement relating to the satellite droplets, the occurrence of which is more conspicuous for stronger airflows in a direction toward the medium.

It is preferable that, the plurality of consecutive nozzles which are allowed to eject the liquid simultaneously are set, in the plurality of nozzles lined up in a row, in a plurality of groups sandwiching a non-ejection nozzle which is caused not to eject liquid.

With this liquid jetting apparatus, the air that flows over the medium surface flows smoothly through the areas corresponding to the non-ejection nozzles. In this way, it is possible to effectively use all the plurality of nozzles lined up in a row.

Further, the number of the non-ejection nozzle is determined according to the spacing from the medium-opposing surface to the surface of the medium.

With this liquid jetting apparatus, the width of the areas through which the air flowing over the medium surface passes can be optimized according to how easy it is for the satellite droplets to land.

Further it is apparent that the following liquid jetting apparatus can also be achieved.

A liquid jetting apparatus comprises:

a head in which a plurality of nozzles lined up in a row are provided in a medium-opposing surface which is in opposition to a medium, a head movement section that moves the head in a predetermined direction along a surface of the medium, a medium placing section on which the medium is placed, a spacing adjustment section that adjusts a spacing between the head and the medium, and an ejection control section that carries out ejection control of a liquid by obtaining a spacing from the medium-opposing surface to the surface of the medium based on information relating to a spacing from a surface of the medium placing section to the medium-opposing surface and information relating to a thickness of the medium, and setting, in the plurality of nozzles lined up in a row, a plurality of groups of consecutive nozzles which are allowed to eject the liquid simultaneously, the groups sandwiching a non-ejection nozzle which is caused not to eject liquid, the number of the non-ejection nozzle being determined according to the spacing from the medium-opposing surface to the surface of the medium, the ejection control section making the number of the consecutive nozzles smaller as the spacing from the medium-opposing surface to the surface of the medium becomes wider, the ejection control section making the number of the consecutive nozzles smaller as an ejection frequency of the liquid becomes higher, wherein the spacing adjustment section is another head movement section that moves the head in a direction approaching the medium and in a direction away from the medium, wherein the information relating to the spacing from the surface of the medium placing section to the medium-opposing surface is information indicating a position of the head determined using the other head movement section, and wherein the information relating to the thickness of the medium is information indicating a type of the medium.

Further, it is apparent that the following liquid jetting method also can be achieved.

A liquid jetting method comprises:

a step of obtaining a spacing from a medium-opposing surface of a head to a surface of a medium, wherein a nozzle row constituted by a plurality of nozzles lined up in a row is arranged on the medium-opposing surface, a step of determining at least one non-ejection nozzle which is caused not to eject a liquid according to the spacing from the medium-opposing surface to the surface of the medium, wherein the non-ejection nozzle is determined among a plurality of nozzles sandwiched between a nozzle at one end of the nozzle row and a nozzle at another end thereof, and a step of ejecting the liquid from nozzles other than the non-ejection nozzle while moving the head in a predetermined direction along the surface of the medium.

A liquid jetting method comprises:

a step of obtaining a spacing from a medium-opposing surface of a head to a surface of a medium, wherein a plurality of nozzles lined up in a row are provided in the medium-opposing surface, a step of limiting the number of consecutive nozzles which are allowed to eject a liquid simultaneously according to the spacing from the medium-opposing surface to the surface of the medium, and a step of ejecting the liquid using at least a portion of the limited number of nozzles while moving the head in a predetermined direction along the surface of the medium.

First Embodiment

Regarding the Liquid Jetting Apparatus

There are various types of liquid jetting apparatuses, such as printing apparatuses, color filter manufacturing apparatuses, display manufacturing apparatuses, semiconductor manufacturing apparatuses, and DNA chip manufacturing apparatuses. To describe all of these apparatuses would present great difficulty. Accordingly, a printing system provided with a printer as a printing apparatus is described in the present specification as an example.

<Regarding the Configuration of the Printing System>

Figure 2:
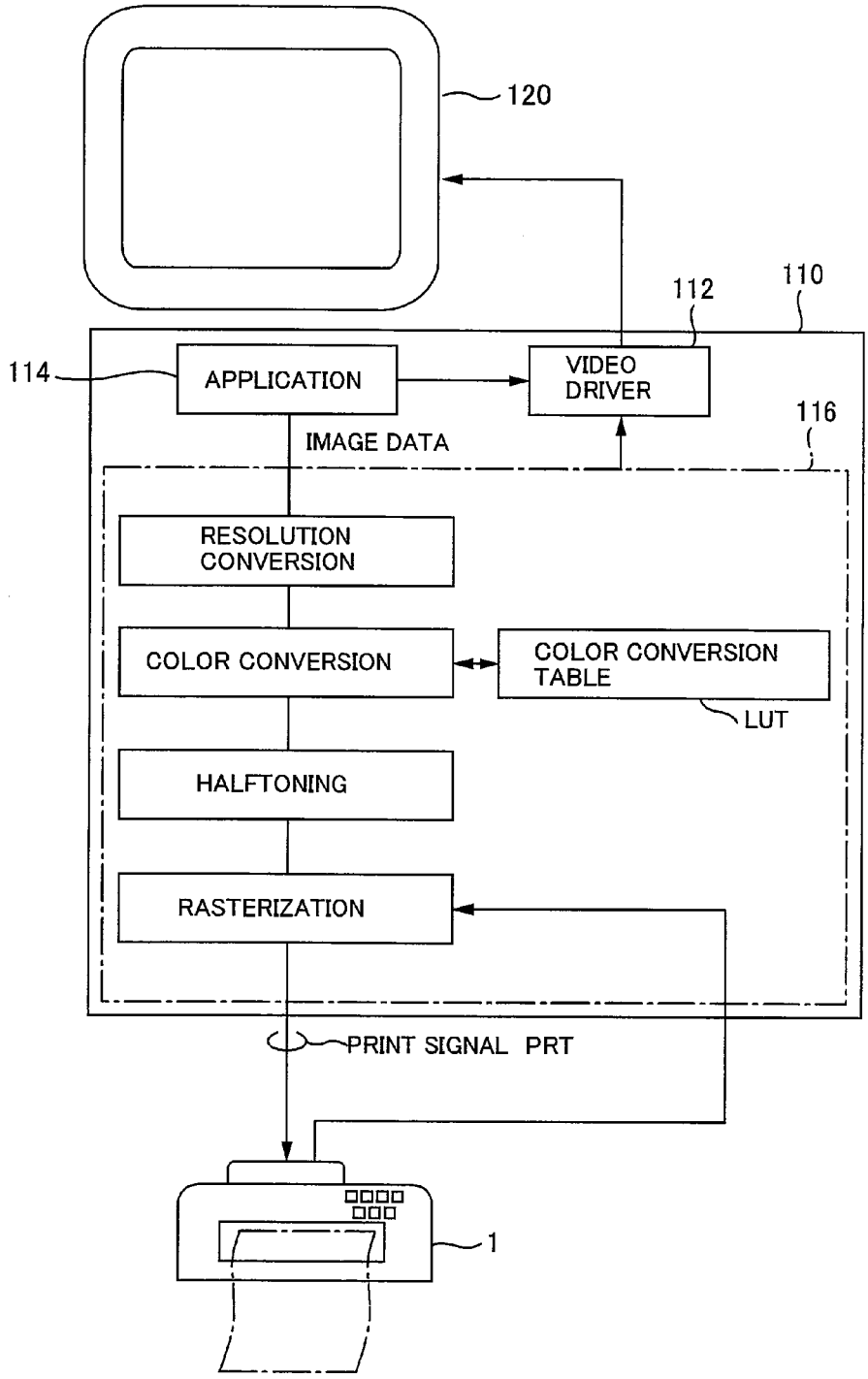
FIG. 2 is a schematic explanatory diagram of basic processings carried out by a printer driver.

FIG. 1 is a diagram showing the overall structure of a printing system 100. FIG. 2 is a schematic explanatory diagram of the basic processings carried out by the printer driver 116. The printing system 100 is provided with a printer 1, a computer 110, a display device 120, input devices 130, and record/play devices 140. The printer 1 is a printing apparatus to print images on a medium such as paper, cloth, or film. It should be noted that the following description is described using a paper S (see FIG. 5) which is a representative medium as an example. The computer 110 is communicably connected to the printer 1, and outputs a print signal PRT corresponding to an image to be printed to the printer 1 in order to print the image with the printer 1. The display device 120 has a display, and displays a user interface such as an application program 114 and a printer driver 116. The input devices 130 are for example a keyboard 131 and a mouse 132, and are used to operate the application program 114 or adjust the settings of the printer driver 116, or the like, in accordance with the user interface that is displayed on the display device 120. The record/play device 140 is a flexible disk drive device 141 or a CD-ROM drive device 142 for example.

The printer driver 116 is installed on the computer 110. The printer driver 116 is a program for achieving the function of displaying the user interface on the display device 120, and in addition it also achieves the function of converting image data that has been output from the application program 114 into the print signal PRT. The printer driver 116 is recorded on a recording medium (computer-readable recording medium) such as a flexible disk FD or a CD-ROM. The printer driver 116 can also be downloaded onto the computer 110 via the Internet. The printer driver 116 includes code to execute the various operations.

It should be noted that "printing apparatus" in a narrow sense means the printer 1, but in a broader sense it means the system constituted by the printer 1 and the computer 110. Accordingly, "printing apparatus" also includes a printer incorporating the above-mentioned printer driver 116 and the application program 114. Thus, "liquid jetting apparatus" can be interpreted likewise.

===Printer Driver===

<Regarding the Printer Driver>

As shown in FIG. 2, on the computer 110, computer programs such as a video driver 112, an application program 114, and the printer driver 116 operate under an operating system installed on the computer 110. The video driver 112 has a function of displaying the user interface or the like on the display device 120 in accordance with display commands from the application program 114 and the printer driver 116. The application program 114 has a function for image editing or the like, and creates data related to an image (image data). A user can give an instruction to print an image edited by the application program 114 via the user interface of the application program 114. Upon receiving the print instruction, the application program 114 outputs the image data to the printer driver 116.

When the printer driver 116 receives the image data from the application program 114, it converts the image data into the print signal PRT. The print signal PRT that has been converted is then output to the printer 1. Here, the "print signal PRT" refers to data in a format that can be interpreted by the printer 1 and that includes various command data and pixel data. Then, the "command data" refers to data for instructing the printer 1 to carry out a specific operation. Furthermore, the "pixel data" refers to data related to pixels that constitute an image to be printed (print image) to the paper S, and for example, is data related to dots to be formed in positions on the paper corresponding to certain pixels, and show the color and size of the dots thereof. The printer driver 116 then carries out processes such as resolution conversion, color conversion, halftoning, and rasterization, converting the image data into the print signals PRT and outputting the converted print signals PRT to the printer 1. The various processes carried out by the printer driver 116 are described below.

Resolution conversion is a process for converting image data (text data, image data, etc.) output from the application program 114 to the resolution (the spacing between dots when printing, also referred to as "print resolution") for printing the image on the paper S. For example, when the print resolution has been specified as 720×720 dpi, then the image data obtained from the application program 114 is converted into image data having a resolution of 720×720 dpi.

Pixel data interpolation and thinning are examples of this conversion method. For example, if the resolution of the image data is lower than the print resolution that has been specified, then linear interpolation or the like is performed to create new pixel data between adjacent pixel data. On the other hand, if the resolution of the image data is higher than the specified print resolution, then the pixel data is thinned, for example, at a set ratio to achieve a uniform print resolution of the image data.

It should be noted that the respective pixel data in the image data is data which has gradation values of many levels (for example, 256 levels) expressed in an RGB color space. The pixel data having such RGB gradation values is hereinafter referred to as "RGB pixel data," and the image data made of these RGB pixel data is referred to as "RGB image data."

Color conversion processing is processing for converting the RGB pixel data of the RGB image data into data having gradation values of many levels (for example, 256 levels) expressed in CMYK color space. C, M, Y and K are the ink colors of the printer 1. C stands for cyan, while M stands for magenta, Y for yellow, and K for black. Hereinafter, the pixel data having CMYK gradation values is referred to as CMYK pixel data, and the image data composed of this CMYK pixel data is referred to as CMYK image data. Color conversion processing is carried out by the printer driver 116 referring to a table that correlates RGB gradation values and CMYK gradation values (color conversion lookup table LUT).

Halftone processing is processing for converting CMYK pixel data having many gradation values into CMYK pixel data having few gradation values which can be expressed by the printer 1. For example, through halftone processing, CMYK pixel data representing 256 gradation values is converted into 2-bit CMYK pixel data representing four gradation values. The 2-bit CMYK pixel data is data that indicates, for each color, for example, "no dot formation" (binary value "00"), "small dot formation" (binary value "01"), "medium dot formation" (binary value "10"), and "large dot formation" (binary value "11").

For example, dithering or the like is used for such a halftone processing to create 2-bit CMYK pixel data with which the printer 1 can form dispersed dots. It should be noted that the method used for halftone processing is not limited to dithering, and it is also possible to use γ correction or error diffusion.

Rasterization is processing for changing the CMYK image data that has been subjected to halftone processing into the data order in which it is to be transferred to the printer 1. Data that has been rasterized is output to the printer 1 as the above print signals PRT. It should be noted that the rasterization in the first embodiment determines non-ejection nozzles which will be caused not to eject ink. The process for determining the non-ejection nozzles will be described in detail later.

<Regarding the Settings of the Printer Driver>

Figure 3:
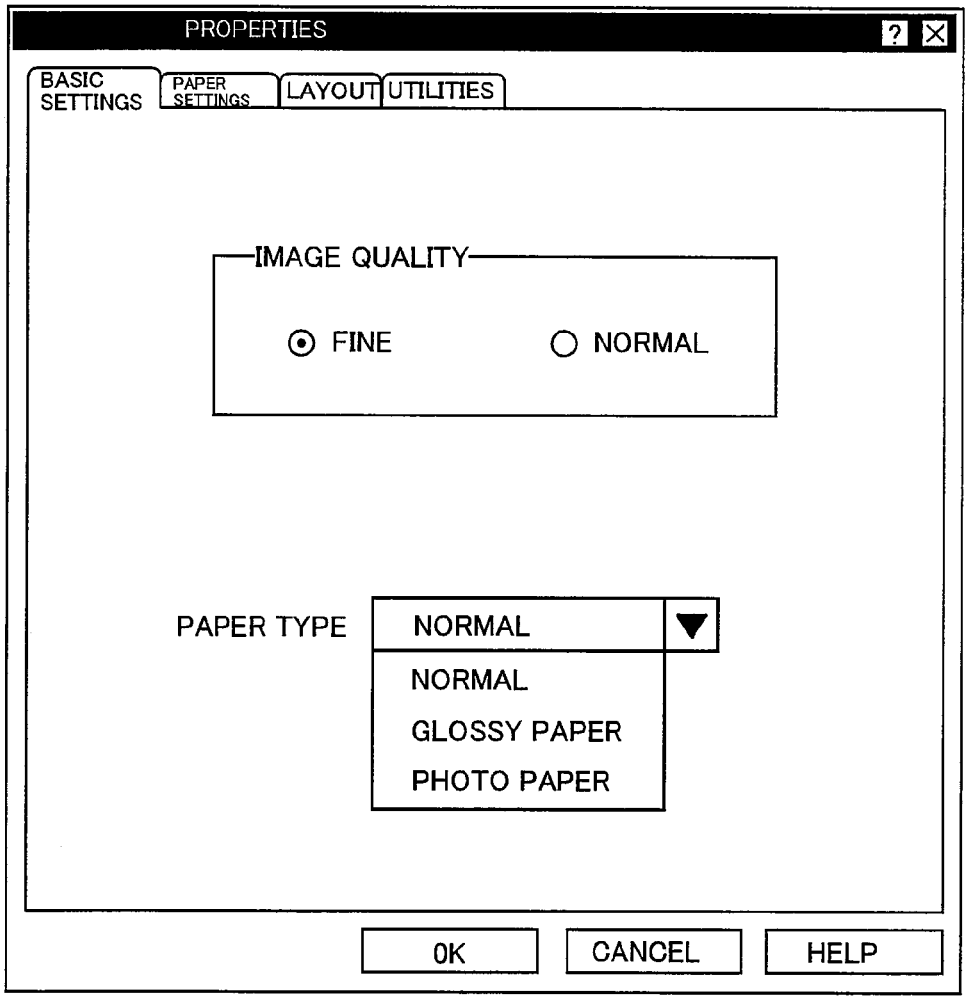
FIG. 3 is an explanatory diagram of a user interface of the printer driver.

FIG. 3 is an explanatory diagram of the user interface of the printer driver 116. The user interface of the printer driver 116 is displayed on the display device 120 via the video driver 112. The user can use the input device 130 to carry out the various settings of the printer driver 116. Basic settings such as that are prepared including image quality settings, and paper type settings.

===Printer===

<Configuration of the Printer>

Figure 4:
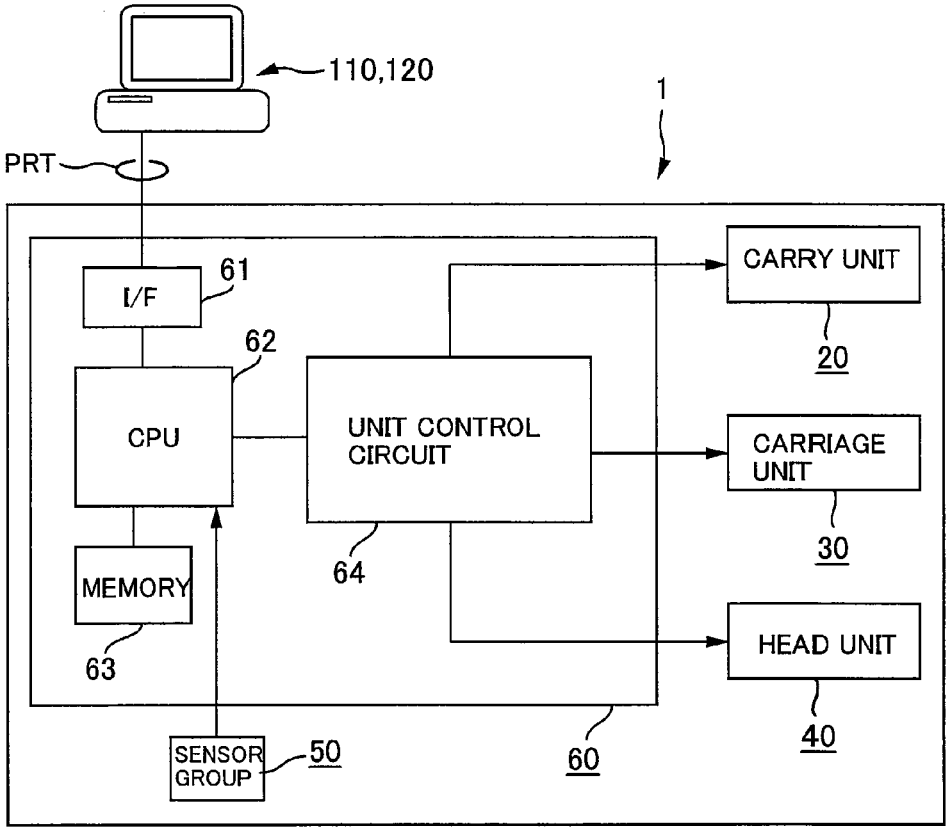
FIG. 4 is a block diagram of the overall configuration of the printer.
Figure 5:
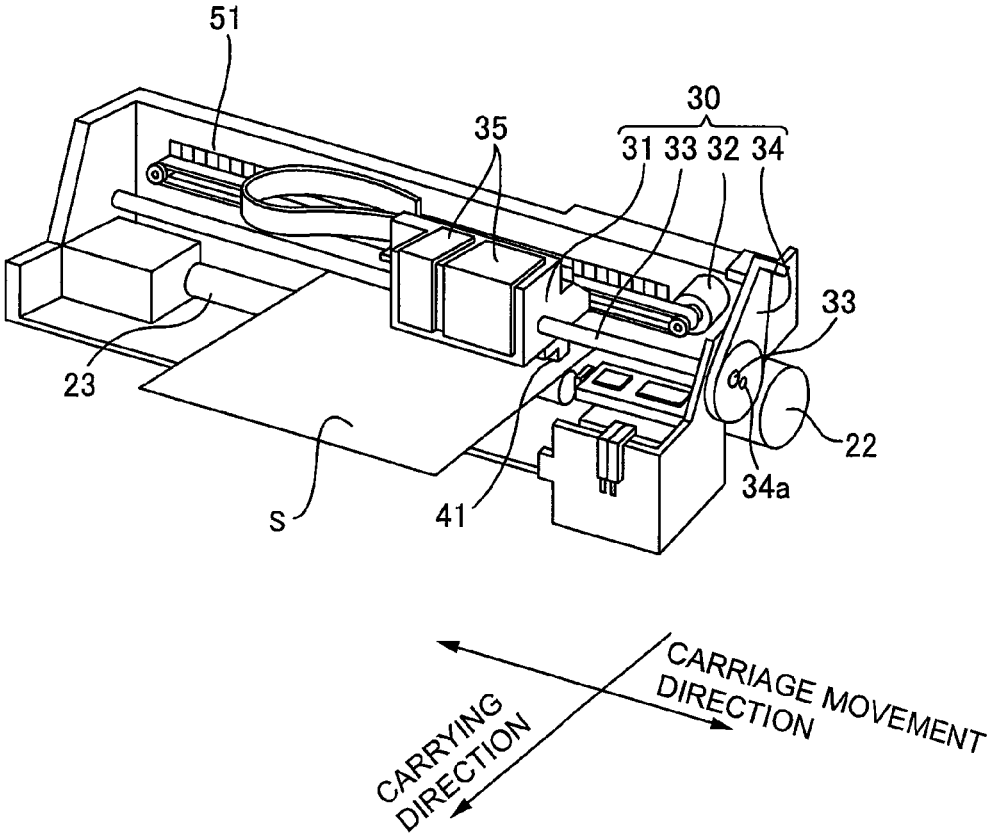
FIG. 5 is a schematic view of the overall configuration of the printer.
Figure 6:
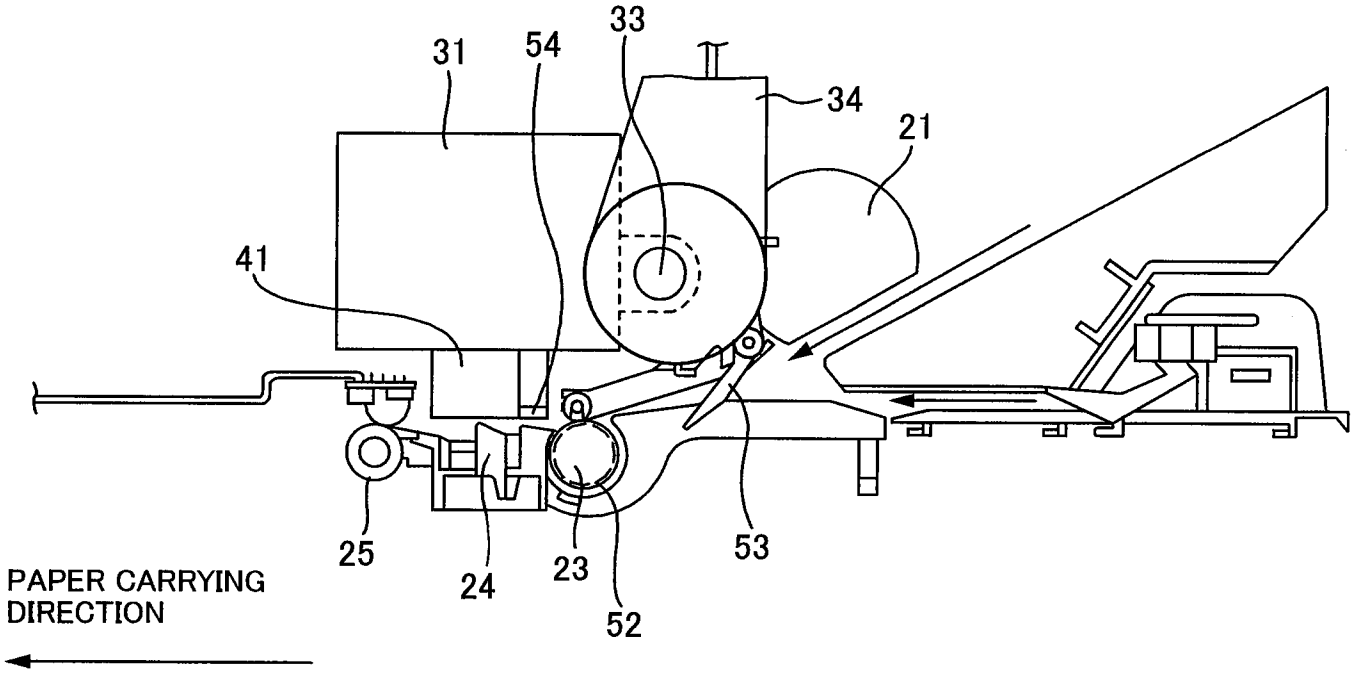
FIG. 6 is a cross sectional view of the overall configuration of the printer.

FIG. 4 is a block diagram of the overall configuration of the printer 1 of this embodiment. FIG. 5 is a schematic diagram of the overall configuration of the printer 1 of this embodiment. FIG. 6 is a cross sectional view of the overall configuration of the printer 1 of this embodiment. The basic structure of the printer 1 according to the present embodiment is described below with reference to these diagrams.

The inkjet printer 1 of this embodiment has a carry unit 20, a carriage unit 30, a head unit 40, a sensor group 50, and a controller 60. The printer 1, which receives print signals PRT from the computer 110, which is an external device, controls the various units (the carry unit 20, the carriage unit 30, and the head unit 40) using the controller 60. The controller 60 controls the units in accordance with the print signals PRT that are received from the computer 110 to print an image on a paper S. Conditions within the printer are monitored by various sensors of the sensor group 50, and the respective sensors output detection results to the controller 60. The controller 60 receives the detection results from the sensors, and controls the units based on these detection results.

The carry unit 20 is for delivering the paper S to a printable position, carrying the paper S by a predetermined carry amount in a predetermined direction (hereinafter, referred to as the "carrying direction") during printing. Here, the carrying direction of the paper S is the direction that intersects the carriage movement direction described below, and can also be expressed as the "sub-scanning direction". The carry unit 20 functions as a carrying mechanism for carrying the paper S. The carry unit 20 has a paper supplying roller 21, a carry motor 22 (also referred to as the "PF motor"), a carry roller 23, a platen 24, and a paper discharge roller 25. The paper supplying roller 21 is a roller for automatically supplying paper S that has been inserted into a paper insert opening into the printer 1. The paper supplying roller 21 has cross-section shaped like the letter D, and the length of its circumferential portion is set longer than the carry distance up to the carry roller 23. Thus, by rotating the paper supplying roller 21 with its circumferential portion abutting against the paper surface, the paper S can be fed to the carry roller 23. The carry motor 22 is a motor for carrying the paper S in the carrying direction, and is constituted by a DC motor, for example. The carry roller 23 is a roller for carrying the paper S that has been supplied by the paper supplying roller 21 up to a printable region, and is driven by the carry motor 22. The platen 24 supports the paper S during printing from the rear surface side of the paper S. That is, the paper S is placed on the platen 24 as the medium. Accordingly, the platen 24 corresponds to a "medium placing section". The paper discharge roller 25 is a roller for carrying the paper S for which printing has finished in the carrying direction. The paper discharge roller 25 is rotated in synchronization with the carry roller 23.

The carriage unit 30 is provided with a carriage 31, a carriage motor 32 (also referred to as "CR motor"), a guide shaft 33, and a gap adjustment lever 34. Ink cartridges 35 containing ink are detachably attached to the carriage 31. Furthermore, a head 41 for ejecting ink from the nozzles is attached to the carriage 31. The carriage motor 32 is a motor for moving the carriage 31 back and forth in a predetermined direction (hereinafter, this is also referred to as the "carriage movement direction"), and for example is constituted by a DC motor. Then, since the head 41 is attached to the carriage 31, the head 41 and the nozzles also move in the same direction due to the movement of the carriage 31 in the carriage movement direction. Consequently, in the printer 1, the carriage movement direction corresponds to a "predetermined direction along the surface of the medium". It should be noted that the carriage movement direction can also be referred to as the "main-scanning direction".

The guide shaft 33 is a member for supporting the carriage 31. The guide shaft 33 of the present embodiment is constituted by a metal rod than is circular in cross section and is provided in the carriage movement direction. Accordingly, when the carriage motor 32 operates, the carriage 31 moves in the carriage movement direction along the guide shaft 33. For this reason, components such as the carriage motor 32 and the guide shaft 33 correspond to a "head movement section".

The gap adjustment lever 34 is a lever for adjusting the spacing between the surface of the head 41 opposing the paper, that is, a "medium-opposing surface", and the upper surface of the platen 24 (corresponding to a "surface of the medium placing section", and hereinafter also referred to as "platen surface"). The gap adjustment lever 34 is inclinably attached with a rotational axle 34*a* at its center. Then, the guide shaft 33 is attached in a position displaced from the rotational axle 34*a* with respect to the gap adjustment lever 34. For this reason, the guide shaft 33 can be moved vertically by inclining the gap adjustment lever 34. Accordingly, the head 41 can be moved in a direction approaching the paper S and in a direction moving away from the paper S.

With a mechanism for adjusting the height of the head 41 using the guide shaft 33 and the gap adjustment lever 34, it is possible to simplify the structure. This is based on a structure in which the position of the head 41 in the height direction is adjusted by moving the guide shaft 33 vertically up or down. Furthermore, the gap adjustment lever 34 and the guide shaft 33 correspond to a "spacing adjustment section" and "another head movement section". It should be noted that vertical movement of the head 41 using the gap adjustment lever 34 and the guide shaft 33 will be described later.

Figure 8:
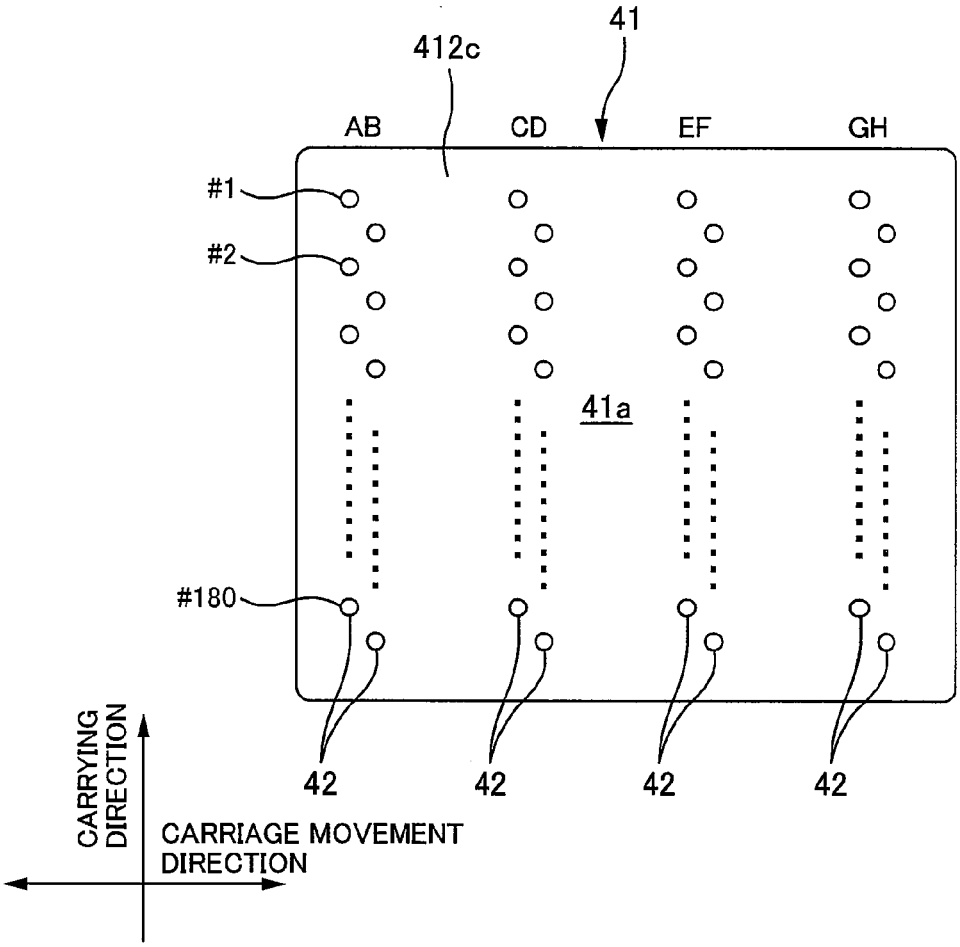
FIG. 8 is a diagram describing the arrangement of nozzles in a paper-opposing surface of the head.

The head unit 40 is for ejecting ink onto the paper S. The head unit 40 has a head 41. As shown in FIG. 8, nozzle rows 42 constituted by a plurality of nozzles (#1 to #180) lined up in rows are provided at a paper-opposing surface 41*a* of the head 41. Ink is ejected intermittently from each nozzle. A raster line made of dots in the carriage movement direction is formed on the paper S when ink is intermittently ejected from the nozzles while the head 41 is moving in the carriage movement direction. It should be noted that the structure of the head 41, the drive circuit for driving the head 41, and the method for driving the head 41 are described later.

The sensor 50 includes a linear encoder 51, a rotary encoder 52, a paper detection sensor 53, a paper width sensor 54, and a head position detection sensor 55 (see FIG. 21), for example.

The linear encoder 51 is for detecting the position in the carriage movement direction, and has a belt-shaped slit plate extending in the carriage movement direction, and a photo interrupter that is attached to the carriage 31 and detects the slits formed in the slit plate. The rotary encoder 52 is for detecting the amount of rotation of the carry roller 23, and has a disk-shaped slit plate that rotates in conjunction with rotation of the carry roller 23, and a photo interrupter for detecting the slits formed in the slit plate.

The paper detection sensor 53 is for detecting the position of the front edge of the paper S to be printed. The paper detection sensor 53 is provided at a position where it can detect the front edge position of the paper S as the paper S is being carried toward the carry roller 23 by the paper supplying roller 21. It should be noted that the paper detection sensor 53 is a mechanical sensor that detects the front edge of the paper S through a mechanical mechanism. More specifically, the paper detection sensor 53 has a lever that can be rotated in the paper carrying direction, and this lever is disposed so that it protrudes into the path over which the paper S is carried. Then, as the paper S is being carried, the front edge of the paper comes into contact with the lever and the lever is rotated. Thus, the paper detection sensor 53 detects the movement of this lever using the photo interrupter or the like, and detects the front end of the paper S and whether or not the paper S is present.

The paper width sensor 54 is attached to the carriage 31. The paper width sensor 54 is an optical sensor, and at a light-receiving section receives the reflection light of the light that has been irradiated onto the paper S from a light-emitting section, and based on the intensity of the light that is received by the light-receiving section, detects whether or not the paper S is present. The paper width sensor 54 detects the positions of the edge portions of the paper S while being moved by the carriage 31, so as to detect the width of the paper S. Furthermore, it is possible to detect the front edge of the paper S using the paper width sensor 54.

The head position detection sensor 55 is for detecting the position of the head 41 in the height direction. In other words, the head position detection sensor 55 is for detecting the position of the head 41 which is determined by the guide shaft 33 and the gap adjustment lever 34 that are the other head movement section. The head position detection sensor 55 is configured by a switch that detects the inclination state of the gap adjustment lever 34. Note that, the head position detection sensor 55 is to be described later.

The controller 60 is a control unit for carrying out control of the printer 1. The controller 60 has an interface section 61, a CPU 62, a memory 63, and a unit control circuit 64. The interface section 61 is for exchanging data between the computer 110, which is an external device, and the printer 1. The CPU 62 is an arithmetic processing device for carrying out overall control of the printer 1. The memory 63 is for ensuring a working region and a region for storing the programs for the CPU 62, and includes a storage element such as a RAM, an EEPROM, or a ROM. Then, the CPU 62 controls the various units via the unit control circuit 64 in accordance with programs stored in the memory 63.

<Regarding the Configuration of the Head>

Figure 7A:
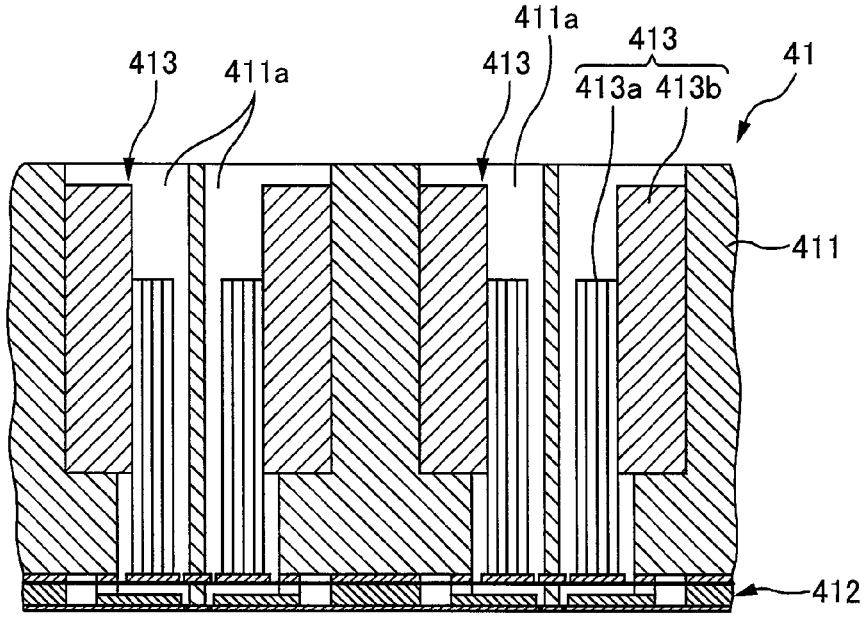
FIG. 7A is a cross sectional view of a portion of a head taken in a direction perpendicular to the nozzle row.
Figure 7B:
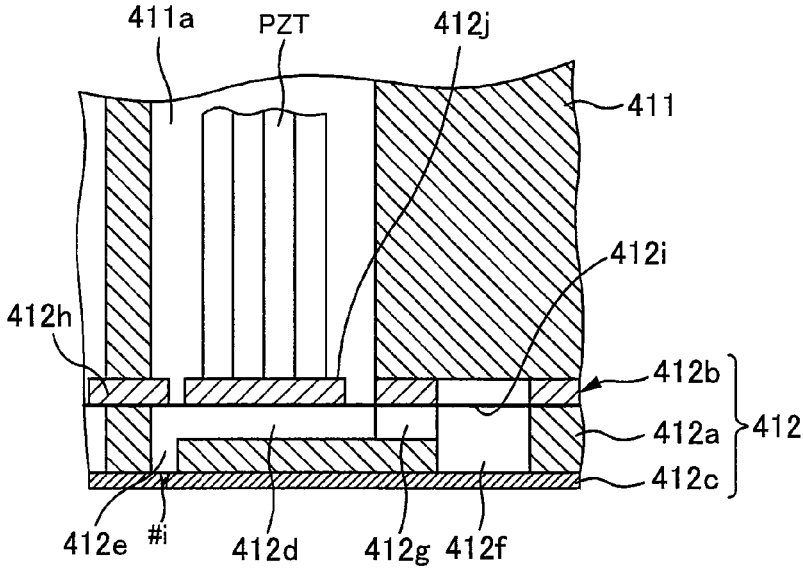
FIG. 7B is an enlarged view of the vicinity of a pressure chamber shown in FIG. 7A.

FIG. 7A is a cross sectional view of a portion of the head 41 taken in a direction perpendicular to the nozzle row 42. FIG. 7B is an enlarged view of the vicinity of a pressure chamber shown in FIG. 7A. FIG. 8 is a diagram describing the arrangement of nozzles #i in a paper-opposing surface 41*a* of the head 41.

The head 41 is provided with a case 411, a flow path unit 412 adhered to a front surface of the case 411, and piezo element units 413 arranged inside the case 411. The case 411 is a block shaped member in which containment chambers 411*a* to contain piezo element units 413 are formed. The case 411 is made of a resin such as an epoxy resin, for example. The containment chambers 411*a* are provided perforating the case 411. Specifically, they are provided spanning from a surface adhered to the flow path unit 412 to an attachment surface of the carriage 31. One containment chamber 411*a* is provided for each piezo element unit 413. Further, one piezo element unit 413 is attached for each nozzle row 42. As will be described below, eight nozzle rows 42 are provided in the present embodiment, and therefore eight containment chambers 411*a* are provided in the case 411 and one piezo element unit 413 is attached in each containment chamber 411*a*.

The flow path unit 412 is provided with a flow-path-forming plate 412*a*, an elastic plate 412*b* joined to one of the surfaces of the flow-path-forming plate 412*a*, and a nozzle plate 412*c* joined to another of the surfaces of the flow-path-forming plate 412*a*. The flow-path-forming plate 412*a* is formed from a silicon wafer or a metal plate, or the like. Groove portions and perforated openings of predetermined shapes are formed in the flow-path-forming plate 412*a*. For example, a groove portion which is a pressure chamber 412*d*, a perforated opening that links the pressure chamber 412*d* and the nozzle #i which is a nozzle link opening 412*e*, a perforated opening which is a shared ink chamber 412*f* (corresponding to a "shared liquid chamber"), and a groove portion that links the pressure chamber 412*d* and the shared ink chamber 412*f* which is an ink supply path 412*g* (corresponding to a "liquid supply path"), are formed.

The elastic plate 412*b* has a support frame 412*h*, an elastic film 412*i* supported by the support frame 412*h*, and an island section 412*j* that abuts a tip end surface of a piezo element PZT. In the elastic plate 412*b*, the island section 412*j* is formed in a portion corresponding to the pressure chamber 412*d*. The surface where the island section 412*j* joins the elastic film 412*i* is slightly smaller than the shape of the opening of a groove portion which is the pressure chamber 412*d*. For this reason, in the periphery of the island section 412*j*, an elastic region is formed by the elastic film 412*i*.

The nozzle plate 412*c* is a thin plate material in which a plurality of nozzles #i are provided. Stainless steel is preferably used for the nozzle plate 412*c*. In the nozzle plate 412*c*, eight nozzle rows 42 constituted by row A to row H are provided. The nozzle rows 42 are arranged such that the direction in which the nozzles #i are lined up is the carrying direction. In this embodiment, one row of the nozzle rows 42 has 180 nozzles (#1 to #180). The respective nozzles #i are formed with a spacing corresponding to 180 dpi. Accordingly, the length of the nozzle rows 42 is approximately one inch. Furthermore, the nozzle rows 42 are arranged lined up in the carriage movement direction. The nozzle rows 42 are in groups of two rows. In the example shown in FIG. 8, the nozzle row 42 of the row A and the nozzle row 42 of the row B belong to the same group, and the nozzle row 42 of the row C and the nozzle row 42 of the row D belong to the same group. Similarly, the nozzle row 42 of the row E and the nozzle row 42 of the row F belong to the same group, and the nozzle row 42 of the row G and the nozzle row 42 of the row H belong to the same group. Then, nozzle rows belonging to the same group are arranged in positions in proximity to each other. Furthermore, the nozzle rows belonging to the same group are formed displaced from each other by a half pitch in the nozzle row direction (carrying direction). On the other hand, the spacing between the groups is wider than the spacing between the nozzle rows belonging to the same group.

The piezo element unit 413 is constituted by a piezo element group 413*a* and an adhesive substrate 413*b*, which adheres on one surface to the piezo element group 413*a* and adheres on another surface to the case 411. The piezo element group 413*a* is manufactured in a comb tooth form by forming slits at a predetermined pitch corresponding to the pressure chambers 412*d* of the flow path unit 412 on a piezo substrate in which piezoelectric bodies and electrode layers are alternately layered. Each tooth of the tooth comb is a piezo element PZT. Accordingly, a single piezo element unit 413 has 180 piezo elements PZT (comb teeth). Furthermore, each piezo element PZT adheres in a state in which a portion of its tip end side protrudes further outward than the edge of the adhesive substrate 413*b*. That is, each piezo element PZT adheres to the adhesive substrate 413*b* in a cantilever state.

The piezo element unit 413 is inserted into the containment chamber 411*a* of the case 411 in a state in which the tip ends of piezo element group 413*a* face toward the flow path unit 412 side. In this state of insertion, the adhesive surface of the contact substrate 413*b* to the case 411 adheres to an inner wall of the case 411. Moreover, with this state of adhesion, the respective tip end surfaces of the piezo elements PZT are adhered to the corresponding island section 412*j*. The piezo elements PZT extend and contract in the lengthwise direction of the elements, which is perpendicular to the layer direction, by a potential difference being applied between opposing electrodes. Due to the expansion and contraction of the piezo elements PZT, the island section 412*j* is pressed toward the pressure chamber 412*d* side, and pulled toward a side away from the pressure chamber 412*d*. At this time, the elastic film 412*i* around the island section deforms, and therefore ink droplets can be ejected from the nozzle.

<Regarding the Drive of the Head>

Figure 9:
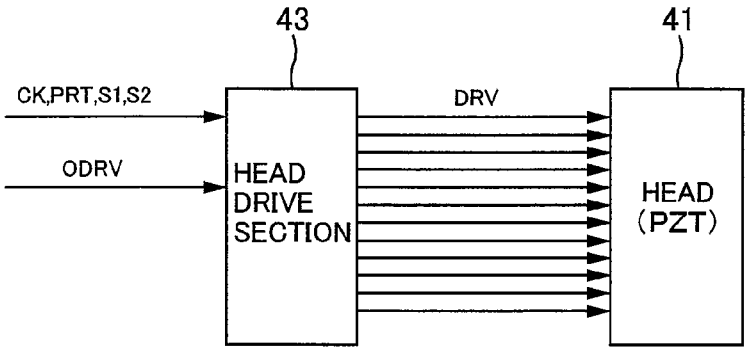
FIG. 9 is a diagram describing a head drive section that drives the head, and peripheral portions thereof.
Figure 10:
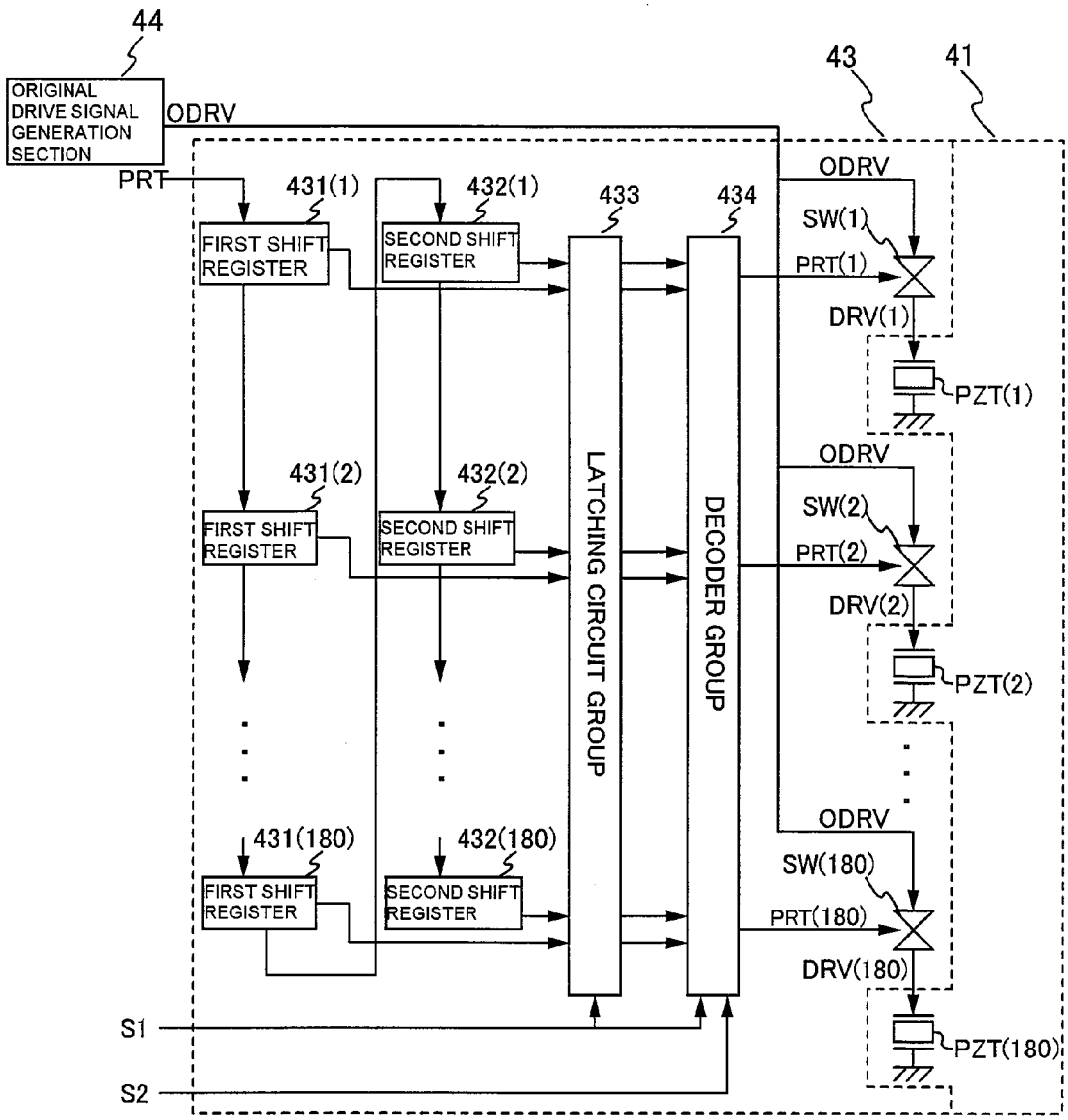
FIG. 10 is a diagram describing the head drive section that drives the head, and specific examples of peripheral portions thereof.
Figure 11:
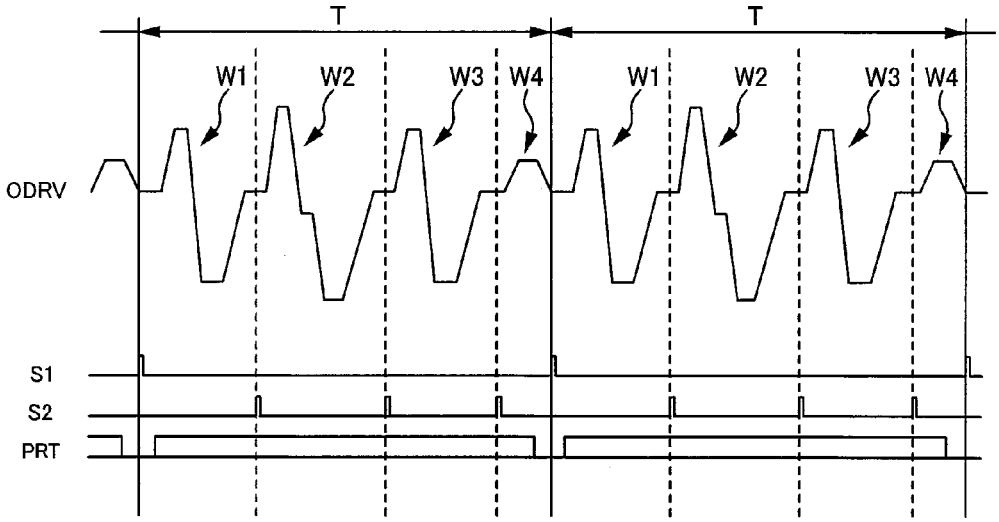
FIG. 11 is a diagram describing an original drive signal generated by an original drive signal generation section.
Figure 12:
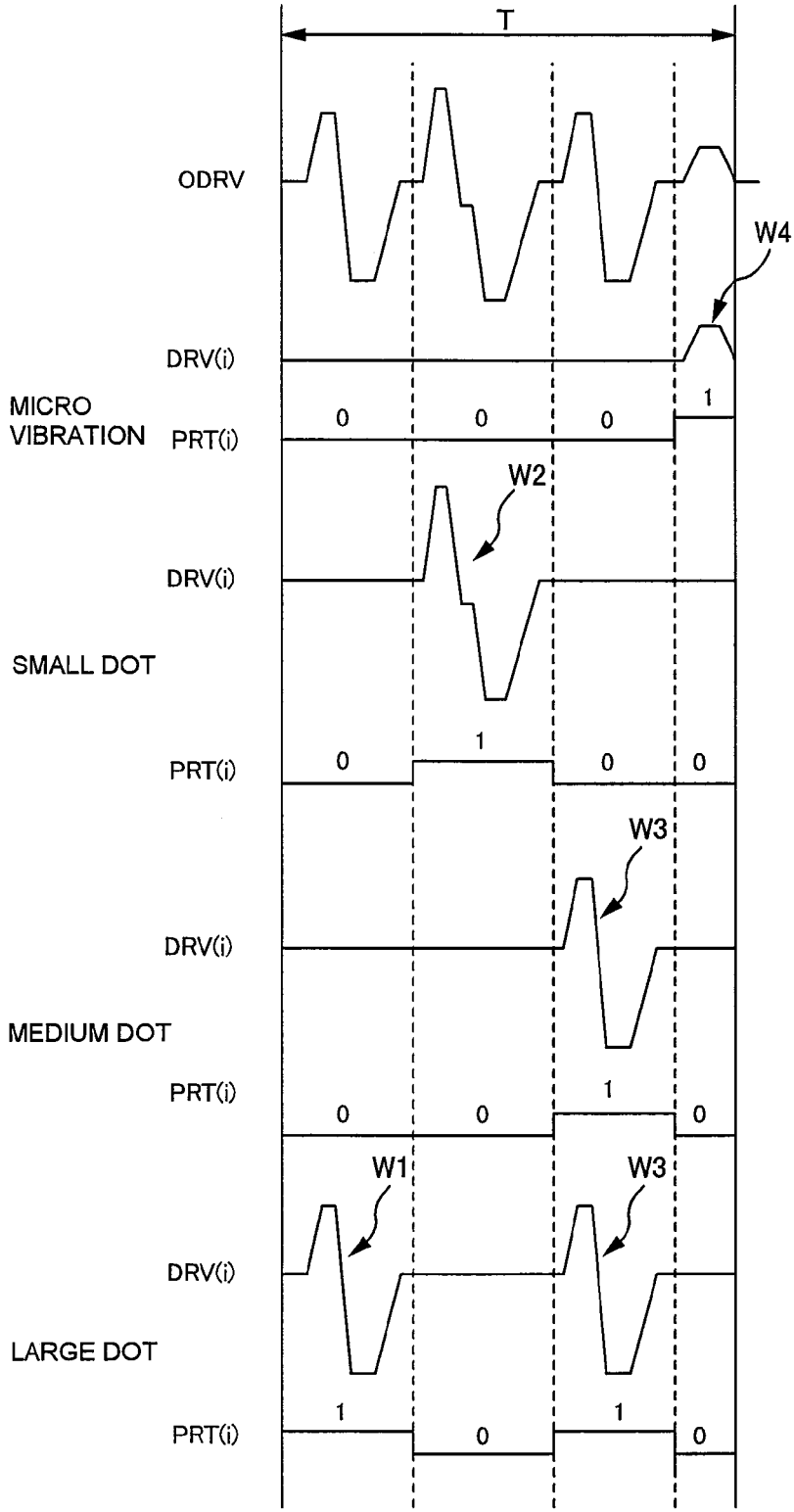
FIG. 12 is a diagram describing a drive signal for each nozzle.

FIGS. 9 and 10 are diagrams describing a head drive section 43 that drives the head 41 and peripheral portions thereof. FIG. 11 is a diagram describing an original drive signal ODRV generated by an original drive signal generation section 44. FIG. 12 is a diagram describing a drive signal DRV(i) for each nozzle.

In order for an ink droplet to be ejected from the nozzles #i, the head drive section 43 drives the corresponding piezo element PZT according to the print signal PRT, which is transmitted serially. This head drive section 43 is provided for each nozzle row 42. The head drive section 43 is provided with a first shift register group 431, a second shift register group 432, a latching circuit group 433, a decoder group 434, and a switch group SW. First shift registers 431(1) to 431(180) of the first shift register group 431, second shift registers 432(1) to 432(180) of the second shift register group 432, a first latching circuit and a second latching circuit (neither shown in drawings) of the latching circuit group 433, decoders (not shown) of the decoder group 434, and switches SW(1) to SW(180) of the switch group SW are provided in a number corresponding to the nozzles #i in the nozzle row 42. In the present embodiment, one nozzle row 42 has 180 nozzles. For this reason, there are 180 of each of the first shift registers, the second shift registers, the decoders, and the switches for each nozzle row 42. Here, the reference numerals shown in parentheses in FIG. 10 indicate the number of the nozzle #i corresponding to the member (or signal).

The first shift registers 431(1) to 431(180), the second shift registers 432(1) to 432(180), the first latching circuit, the second latching circuit, the decoder, and the switches SW(1) to SW(180) are grouped for each nozzle. The input of the first latching circuit is connected to the corresponding first shift registers 431(1) to 431(180) and the input of the second latching circuit is connected to the corresponding second shift registers 432(1) to 432(180). Furthermore, the output of the first latching circuit and the second latching circuit is connected to the corresponding decoders. Further, the output of the decoders is connected to the corresponding switches SW(1) to SW(180).

The original drive signal ODRV is a signal that is to be the basis of the drive signal DRV(i) for each nozzle, and is a common signal for the respective piezo elements PZT. In this embodiment, the original drive signal ODRV has four drive pulses, namely a first drive pulse W1 to a fourth drive pulse W4, in a time T during which a single nozzle #1 crosses over the distance of one pixel. Here, the first drive pulse W1 is a drive pulse for a medium dot. In other words, when the first drive pulse W1 is supplied to the piezo elements PZT, a medium ink droplet of an amount corresponding to a medium dot is ejected from the nozzle #i. The second drive pulse W2 is a drive pulse for a small dot. In other words, by supplying the second drive pulse W2 to the piezo elements PZT, a small ink droplet of an amount corresponding to a small dot is ejected from the nozzle #i. The third drive pulse W3 is a drive pulse for a medium dot the same as the first drive pulse W1. The fourth drive pulse W4 is a drive pulse for a micro vibration. In other words, when the fourth drive pulse W4 is supplied to the piezo elements PZT, a meniscus micro-vibrates, thus preventing thickening of the ink.

The print signal PRT is a signal which includes pixel data for the number of nozzles and which is transmitted serially. The print signal PRT is input to the head drive section 43. Then, two-bit pixel data is converted into the print signal PRT(i), which is pulse selection data for each nozzle. The print signal PRT(i) is a signal corresponding to the pixel data and is allotted for each pixel handled by the nozzle #i. In the present embodiment, the original drive signal ODRV has four drive pulses (the first pulse W1 to the fourth pulse W4) during the time T that a nozzle crosses over the length of a single pixel, and therefore the print signal PRT(i) has 4-bit data for a single pixel. Then, each bit of the print signal PRT(i) indicates ON/OFF for the corresponding drive pulse. The print signals PRT(i) are output from the decoder to the switches SW(i).

The drive signals DRV(i) are signals for driving the piezo elements PZT(i). The drive signals DRV(i) of the present embodiment are obtained by controlling the supply of the original drive signal ODRV to the piezo elements PZT(i) according to the print signals PRT(i). When the drive signals DRV(i) are input to the piezo elements PZT(i), the piezo elements PZT(i) deform in response to the voltage change of the drive signals DRV(i). When the piezo elements PZT(i) deform, the elastic film 412*i* (side wall) which partitions a portion of the pressure chamber 412*d* deforms, so that ink is ejected from the nozzle #i, and the meniscus of the nozzle #i is caused to micro-vibrate.

A first control signal S1 is input to the latching circuit group 433 and the decoder group 434. Further, a second control signal S2 is input to the decoder group 434. The first control signal S1 and the second control signal S2 have pulses that indicate the timing of change of the print signals PRT(i).

As will be described below, the print signal PRT (2-bit pixel data) that is transmitted serially to the head drive section 43 is converted into the print signals PRT(i), which are 4-bit data for each nozzle. First, the high-order bits of the pixel data included in the print signals PRT are input to the first shift register group 431 in nozzle order. Next, the lower-order bits of the pixel data are input to the first shift register group 431 in nozzle order. Since the second shift register group 432 is serially connected downstream from the first shift register group 431, here, the higher-order bits of the pixel data are shifted from the first shift register group 431 to the second shift register group 432 when the lower-order bits of the pixel data are input to the first shift register group.

Once all the print signals PRT are set in the shift register groups 431 and 432, the pulse of the first control signal S1 is input to the latching circuit group 433. In this way, the data of the shift register groups 431 and 432 is latched in the latching circuit group 433. That is, the print signals PRT (for example, the lower-order bits of the pixel data) that have been set in the first shift register are latched in the first latching circuit and the print signals PRT (for example, the higher-order bits of the pixel data) that have been set in the second shift register are latched in the second latching circuit.

When the pulse of the first control signal S1 is input to the latching circuit group 433, a pulse of the first control signal S1 is also input to the decoder group 434. When the first control signal S1 is input, the decoder group 434 translates the print signals PRT that are latched in the latching circuit group 433 and obtains 4-bit print signals PRT(i) as pulse selection signals. The thus-obtained print signals PRT(i) are output to the switch group SW in order from the higher-order bits. That is, when the pulse of the first control signal S1 is input to the latching circuit group 433, the higher-order bit of the print signals PRT(i) is output to the switch group SW. Next, when the first pulse of the second control signal S2 is input to the decoder group 434, the second from the highest order bit of the print signals PRT(i) is output to the switch group SW. Similarly, when the second pulse of the second control signal S2 is input to the decoder group 434, the third from the highest order bit of the print signals PRT(i) is output to the switch group SW and when the third pulse of the second control signal S2 is input to the decoder group 434, the lowest order bit of the print signals PRT(i) is output to the switch group SW. In this way, the print signals PRT that are transmitted serially are converted to the print signals PRT(i) for 180 nozzles and output to the switch group SW.

When the level of the print signal PRT(i) is "1", a switch SW(i) of the switch group SW allows the drive pulse for the original drive signal ODRV to pass unchanged and sets it as a drive signal DRV(i). On the other hand, when the level of the print signal PRT is "0", the switch SW(i) blocks the corresponding drive pulse of the original drive signal ODRV.

In the present embodiment, when the pixel data contained in the print signal PRT(i) is "00", the corresponding decoder of the decoder group 434 outputs "0001" as the print signal PRT(i). In this way, the fourth pulse W4 is supplied to the piezo element PZT(i) and causes the meniscus therein to micro-vibrate. Furthermore, when the pixel data is "01", the decoder outputs "0100" as the print signal PRT(i). In this way, the second pulse W2 is supplied to the piezo element PZT(i) and causes a small dot to be formed. Furthermore, when the pixel data is "10", the decoder outputs "0010" as the print signal PRT(i). In this way, the third pulse W3 is supplied to the piezo element PZT(i) and causes a medium dot to be formed. It should be noted that when the pixel data is "10", it is also possible to output "1000" from the decoder as the print signal PRT(i) and to supply the first pulse W1 to the piezo element PZT(i). Further still, when the pixel data is "11", the decoder outputs "1010" as the print signal PRT(i). In this way, the first pulse W1 and the third pulse W3 are supplied to the piezo element PZT(i) and causes a large dot to be formed by two medium ink droplets.

It should be noted that a plurality of types of original drive signals ODRV are prepared according to the print mode. The frequency of drive pulse supply to the piezo elements PZT(i) is determined for every original drive signal. When "normal" is set as the image quality, the supply frequency of drive pulses is 14.4 kHz, for example. In this case, the ejection frequency of ink droplets also becomes 14.4 kHz. On the other hand, when "fine" is set as the image quality, the supply frequency of drive pulses is 7.2 kHz, for example. In this case, the ejection frequency of ink droplets also becomes 7.2 kHz.

<Regarding the Printing Operation>

Figure 13:
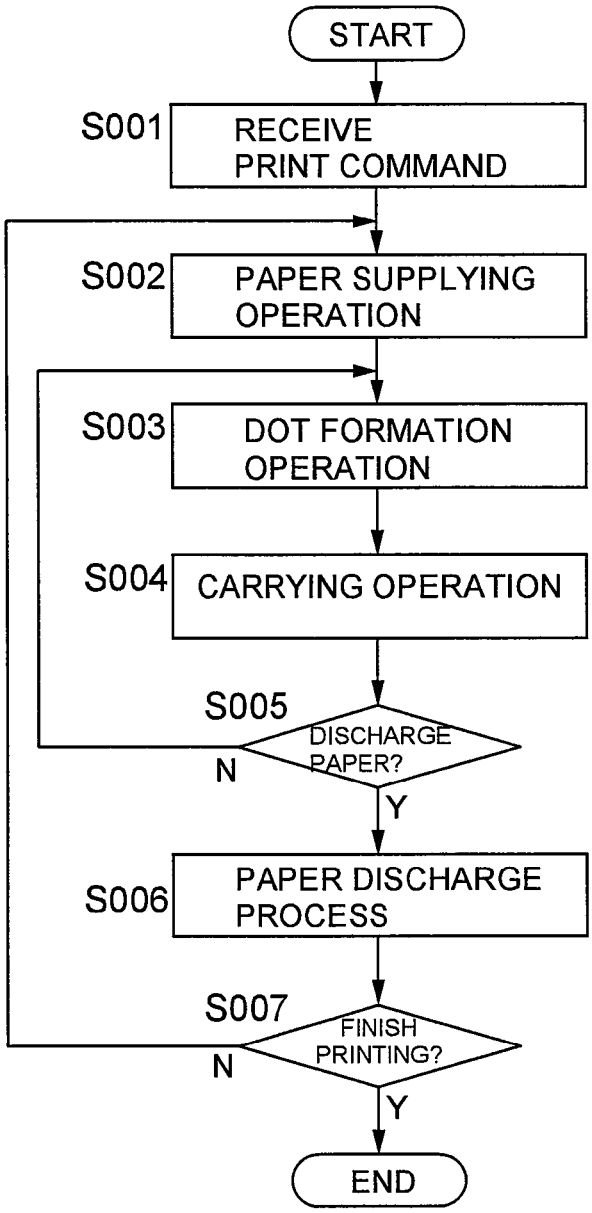
FIG. 13 is a flowchart of the processing during printing.

FIG. 13 is a flowchart of the processing during printing. The various operations that are described below are executed by the controller 60 controlling the various units in accordance with a program stored in the memory 63. This program includes code for executing the various processes.

Receive Print Command (S001): The controller 60 receives a print command via the interface section 61 from the computer 110. This print command is included in the header of the print signal PRT transmitted from the computer 110. The controller 60 then analyzes the content of the various commands included in the print signals PRT that are received, controls the various units, so as to perform the following paper supplying operation, carrying operation, and dot formation operation, and the like.

Paper Supplying Operation (S002): Next, the controller 60 performs the paper supplying operation. The paper supplying operation is a process for moving the paper S which is the medium to be printed, and positioning it at a print start position (the so-called indexing position). In other words, the controller 60 rotates the paper supplying roller 21 to feed the paper S to be printed up to the carry roller 23. Next, the controller 60 rotates the carry roller 23 to position the paper S that has been fed from the paper supplying roller 21 at the print start position.

Dot Formation Operation (S003): Next, the controller 60 performs the dot formation operation. The dot formation operation is an operation for intermittently ejecting ink from the head 41 moving in the carriage movement direction, so as to form dots on the paper S. The controller 60 drives the carriage motor 32 to move the carriage 31 in the carriage movement direction. The controller 60 causes ink to be ejected from the head 41 (i.e., from the nozzles) in accordance with the print signal PRT while the carriage 31 is moving. Dots are then formed on the paper when ink ejected from the head 41 lands on the paper.

Carrying Operation (S004): Next, the controller 60 performs the carrying operation. The carrying operation is a process for moving the paper S relative to the head 41 in the carrying direction. The controller 60 drives the carry motor 22 to rotate the carry roller 23 and thereby carry the paper S in the carrying direction. Through this carrying operation, the head 41 can form dots at positions that are different from the positions of the dots formed in the preceding dot formation operation.

Paper Discharge Operation (S005): Next, the controller 60 determines whether or not to discharge the paper S that is being printed. At the time of this determination, the paper is not discharged if there remains data to be printed on the paper S that is being printed. Then, the controller 60 repeats in alternation the dot formation operation and the carrying operation until there is no longer any data for printing, gradually printing an image made of dots on the paper S. When there is no more data for printing to the paper S that is being printed, the controller 60 makes a determination to carry out paper discharge.

Paper Discharge Process (S006): Next, the controller 60 discharges the paper S that has been printed. That is, the controller 60 discharges the paper S which has been printed to the outside by rotating the paper discharge roller 25.

Print End Determination (S007): Next, the controller 60 determines whether or not to continue printing. If the next sheet of paper S is to be printed, then printing is continued and the paper feed operation for the next sheet of paper S is begun. If the next sheet of paper S is not to be printed, then the printing operation is terminated.

===Regarding the Wind Ripple Pattern Phenomenon===

<Regarding Landing Position Displacement of Satellite Ink>

Before describing the wind ripple pattern phenomenon, displacement of the landing position of a satellite ink droplet is described. Here, FIGS. 14A and 14B are schematic diagrams describing the formation process of ink droplets. Further, FIG. 15A is a diagram schematically showing the flight trajectory of an ink droplet. FIG. 15B is a diagram schematically showing landing position displacement of main ink droplets and the satellite ink droplets, in which landing position displacement that occurs ordinarily is shown.

With the printer 1 of this type, the ink droplet ejected from the nozzle #i separates and flies as the main ink droplet Im and the satellite ink droplet Is. This is considered to occur because, in the process of forming an ink droplet, the ink goes through a stage (see FIG. 14A) in which ink pushed out from the nozzle #i lengthens into a column shape, and a stage (see FIG. 14B) in which the ink column segments due to surface tension. It should be noted that the likeliness of the satellite ink droplets Is to be produced, varies depending on the viscosity of the ink and the flight velocity of the ink. For example, an ink to be used in an operating environment of a temperature range of approximately 10° C. to 40° C. has a viscosity in the range of approximately 2.0 to 12.0 mPa/sec. Specifically, as an ordinary ink, there can be ink with a viscosity in the range of approximately 2.0 to 6.5 mPa/sec. Furthermore, as high-viscosity pigment inks, there can be ink with a viscosity in the range of approximately 8 to 11 mPa/sec. There are such differences in viscosity, but taking into consideration that the inks that can be ejected by the head 41 with the above-described structure, it would be extremely difficult to control so that the satellite ink droplets Is are not produced.

The main ink droplet Im and the satellite ink droplet Is produced in this way are affected by the air (in this example, a horizontal direction wind, which for convenience is also referred to as a crosswind Ws in the description below) that flows along the surface of the paper (corresponding to a "medium surface") accompanying the movement of the carriage 31. Moreover, these ink droplets have different flight velocities in the direction toward the paper (a vertical direction in this example), and the satellite ink droplet Is has a slower flight velocity than the main ink droplet Im. Further still, the satellite ink droplet Is has a smaller amount as compared to the main ink droplet Im. Consequently, the satellite ink droplet Is is more strongly affected by the crosswind Ws as compared to the main ink droplet Im. As a result, the satellite ink droplet Is lands further on the downwind side of the crosswind Ws than the main ink droplet Im. The amount of landing position displacement between the satellite ink droplets Is and the main ink droplets Im varies depending on such factors as differences between the flight velocities of the ink droplets Im and Is, a spacing PGa from a paper-opposing surface 41*a* of the head 41 to the paper surface (the vertical flight distance of the ink droplets, see FIG. 15A), and the velocity of the crosswind Ws (a movement velocity Vcr of the carriage 31).

<Regarding Causes of Occurrence of the Wind Ripple Pattern Phenomenon>

Figure 16:
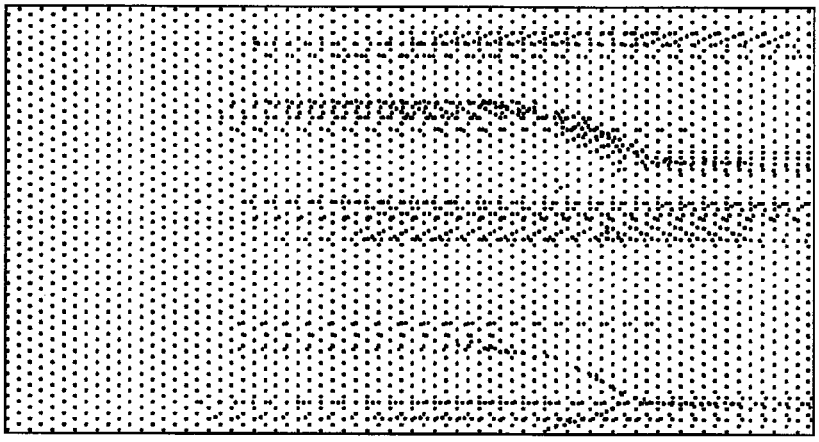
FIG. 16 is a schematic diagram showing a pattern produced by unexpected landing position displacement of the satellite ink droplets.
Figure 17:
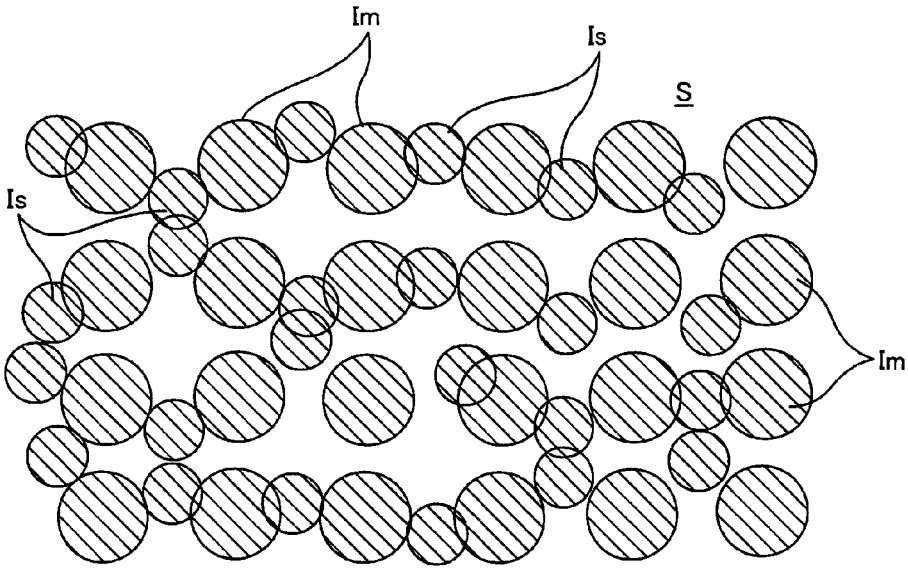
FIG. 17 is a schematic diagram showing enlarged a portion in which unexpected landing position displacement has occurred.

Incidentally, as mentioned above, when the number of nozzles #i that constitute a single nozzle row 42 increases, or the movement velocity of the carriage 31 (head 41) increases, or the ejection frequency of ink droplets increases, the landing position of the satellite ink droplets Is becomes greatly displaced from the regular position, thus causing unexpected landing position displacement. Here, FIG. 16 is a schematic diagram showing a pattern produced by unexpected landing position displacement of the satellite ink droplets Is. FIG. 17 is a schematic diagram showing a magnified portion in which unexpected landing position displacement has occurred.

As shown in FIG. 16, a pattern resembling a pattern made by wind on the surface of a sand dune (that is, a wind ripple pattern) is formed on the surface of the paper by the unexpected landing position displacements of the satellite ink droplets Is. For convenience, the phenomenon by which a pattern resembling this wind ripple pattern is formed will be referred to in the following description as a wind ripple pattern phenomenon. As shown in FIG. 17, this pattern resembling a wind ripple pattern is formed mainly due to the landing position displacement of satellite ink droplets Is. That is, originally, the main ink droplets Im and the satellite ink droplets Is land lined up in the carriage movement direction as shown in FIG. 15B. However, in locations where the wind ripple pattern phenomenon has occurred, the landing position of the satellite ink droplets Is is greatly displaced. A pattern resembling this wind ripple pattern results in reduced image quality and prevents increase in image quality. Accordingly, there is required a way to prevent occurrence of the wind ripple pattern phenomenon.

Causes of occurrence of the wind ripple pattern phenomenon are considered here. As mentioned above, the wind ripple pattern phenomenon is mainly caused by satellite ink droplets Is landing displaced from their regular positions. Therefore, it can be conceived that the size (weight) and flight velocity of the satellite ink droplets Is and the turbulence of the crosswind Ws play a part in the wind ripple pattern phenomenon. That is, the satellite ink droplets Is are considerably small compared to the main ink droplets Im, and therefore the extent to which they decelerate in flight is greater compared to the main ink droplets Im. As an example, the ink weight of a main ink droplet Im is 5.0 ng and its flight velocity is 9 m/s. On the other hand, the ink weight of a satellite ink droplet Is is 2.7 ng and its flight velocity is 6 m/s. In this way, since its weight is smaller and its flight velocity slower, the satellite ink droplet Is is more easily affected by the crosswind Ws compared to the main ink droplet Im. As a result, it can be conceived that the landing position displacement of the satellite ink droplets Is occurs due to the turbulence of the crosswind Ws.

Figure 18A:
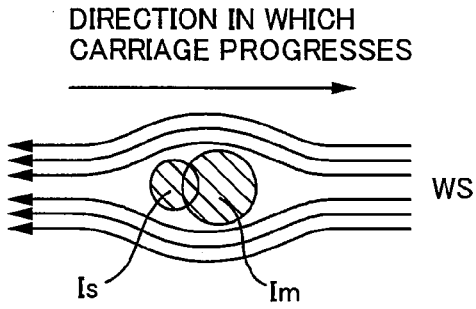
FIG. 18A is a diagram schematically showing a crosswind when ink droplets are ejected from a single nozzle.
Figure 18B:
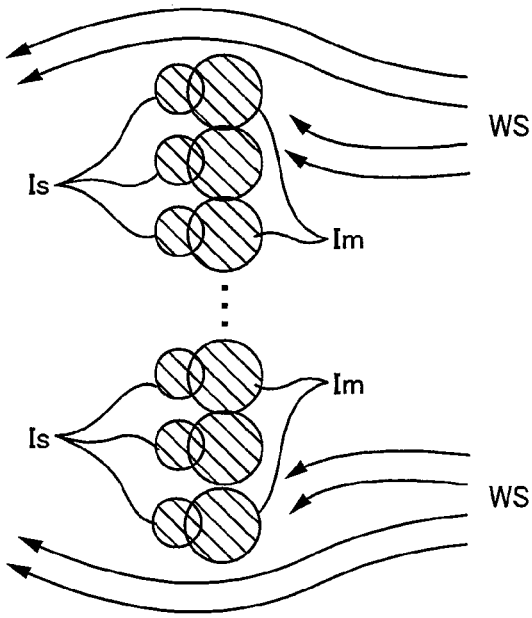
FIG. 18B is a diagram schematically showing the crosswind when ink droplets are ejected from a plurality of consecutive nozzles.
Figure 19:
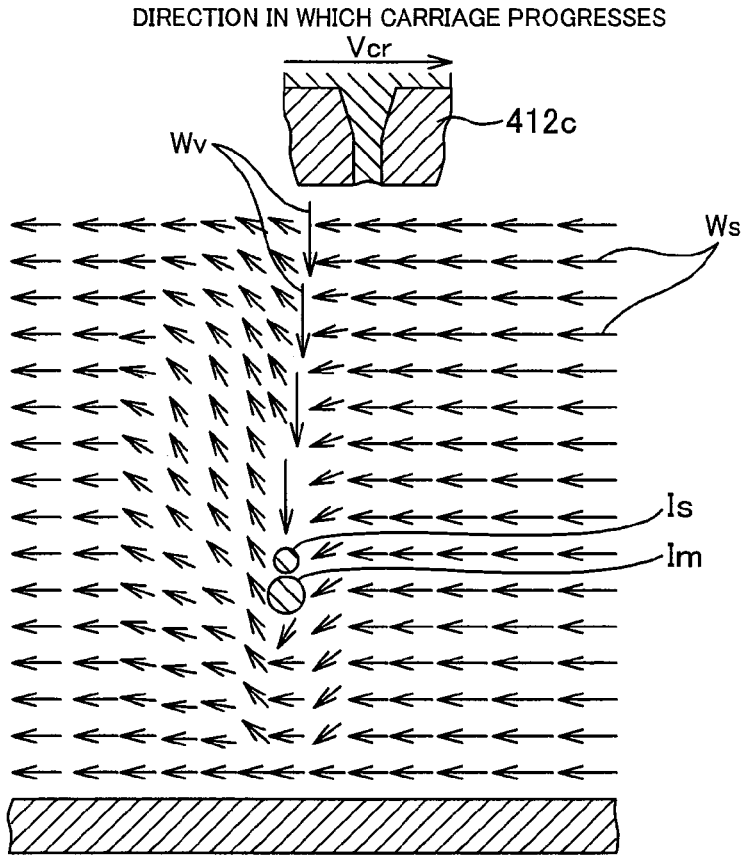
FIG. 19 is a diagram schematically showing a relationship between a downward wind produced by ejected ink droplets and the crosswind.
Figure 20:
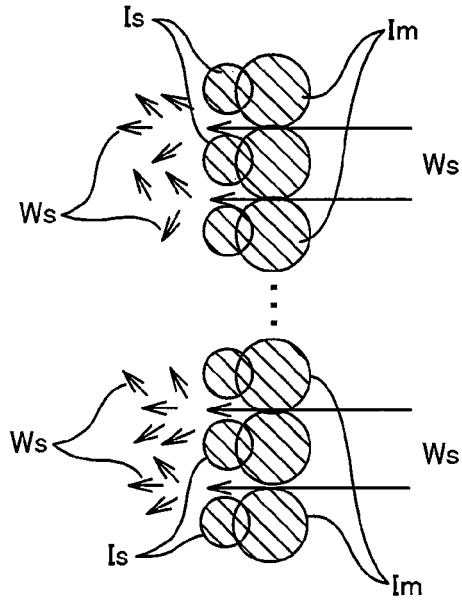
FIG. 20 is a drawing schematically showing a state in which the downward wind is broken by the crosswind.

The turbulence of the crosswind Ws is examined next. Here, FIG. 18A is a diagram schematically showing the crosswind Ws when ink droplets (Im and Is) are ejected from a single nozzle #i. FIG. 18B is a diagram schematically showing the crosswind Ws when ink droplets (Im and Is) are ejected from a plurality of consecutive nozzles #i. Further, FIG. 19 is a diagram schematically showing a relationship between an air flow produced by ejected ink droplets (for the sake of convenience also called a downward wind Wv in the following description) and the crosswind Ws. FIG. 20 is a diagram schematically showing a state in which the downward wind Wv is broken by the crosswind Ws.

According to simulations, the crosswind Ws during movement of the carriage 31 flows in an opposite direction to the direction in which the carriage 31 progresses. When ink droplets are ejected from a single nozzle #i, as shown in FIG. 18A, the crosswind Ws flows by avoiding the ink droplets. This is considered to occur because the downward wind Wv, that is, the flow of air in a direction toward the paper S, has been produced by repeatedly ejecting ink droplets as shown in FIG. 19. In this case, the flow of the crosswind Ws has to change only for a single nozzle #i, and therefore flows smoothly.

Then, when ink droplets are ejected from a plurality of consecutive nozzles #i, as shown in FIG. 18B, the flow of the crosswind Ws is now required to change for the amount corresponding to these nozzles #i. That is, it is conceivable that, due to ink droplets being repetitively ejected from these nozzles #i, the downward wind Wv exerts a function similar to an air curtain. Consequently, in this case, it can be considered that the crosswind Ws comes in contact with the downward wind Wv and changes the direction thereof. Then, a force in an opposite direction to the direction in which the carriage 31 progresses (hereinafter, also referred to as "crosswind Ws force") is applied to the downward wind Wv (air curtain) by coming in contact with the crosswind Ws.

The crosswind Ws force becomes stronger as the number of consecutive nozzles #i increases. Furthermore, the force becomes stronger as the movement velocity Vcr of the carriage 31 becomes faster, that is, as the flow of the crosswind Ws becomes faster. On the other hand, the downward wind Wv force becomes weaker as spacings PGa from the paper-opposing surface 41*a* of the head 41 to the surface of the paper widens. Then, when the crosswind Ws force becomes stronger than the downward wind Wv force, the crosswind Ws breaks through the downward wind Wv, for example, as shown in FIG. 20. In this state, the flow of the crosswind Ws is made turbulent by interaction with the downward wind Wv. It is conceived that the landing positions of the satellite ink droplets Is become displaced from the regular positions due to the crosswind Ws whose flow has been made turbulent, thus causing the above-described wind ripple pattern phenomenon.

Here, results of experiments in which the number of consecutive nozzles #i that eject ink droplets was varied and the conditions of wind ripple pattern phenomenon occurrence in these cases were examined, are shown in Table 1 and Table 2.

TABLE 1

| Number of consecutive nozzles | Satellite position displacement |
|---|---|
| 20 | Completely unnoticeable |
| 30 | Completely unnoticeable |
| 40 | Extremely conspicuous |
| 50 | Extremely conspicuous |

Ink weight: 7.7 ng, carriage movement velocity: 200 cps, flight velocity of main ink droplet: 9.0 m/s, spacing between nozzle surface and paper surface: 1.7 mm, drive frequency: 14.4 kHz, nozzle resolution: 180 dpi

TABLE 2

| Number of consecutive nozzles | Satellite position displacement |
|---|---|
| 31 | Completely unnoticeable |
| 32 | Completely unnoticeable |
| 33 | Noticeable upon close inspection |
| 34 | Noticeable upon close inspection |
| 35 | Noticeable upon close inspection |
| 36 | Conspicuous |
| 37 | Conspicuous |
| 38 | Conspicuous |
| 39 | Extremely conspicuous |
| 40 | Extremely conspicuous |
| 41 | Extremely conspicuous |
| 42 | Extremely conspicuous |

Ink weight: 7.7 ng, carriage movement velocity: 200 cps, flight velocity of main ink droplet: 9.0 m/s, spacing between nozzle surface and paper surface: 1.7 mm, drive frequency: 14.4 kHz, nozzle resolution: 180 dpi Under the conditions of this experiment, the occurrence of the wind ripple pattern phenomenon was visually confirmed when the number of consecutive nozzles #i ejecting ink droplets was 33 or higher. It was also confirmed that the wind ripple pattern phenomenon became more conspicuous as the number of consecutive nozzles #i increased. Note that, it can be considered that the number of nozzles #i at which the occurrence of wind ripple pattern phenomenon is confirmed is determined according to such factors as the spacing PGa from the paper-opposing surface 41*a* of the head 41 to the paper surface, the movement velocity Vcr of the carriage 31, and the density (formation pitch) of the nozzles #i.

The results of an experiment in which the occurrence conditions of the wind ripple pattern phenomenon were examined while varying the spacing PGa from the paper-opposing surface 41*a* of the head 41 to the paper surface are shown in Table 3.

TABLE 3

| Paper-opposing surface to paper surface | Vm | Satellite position displacement |
|---|---|---|
| 0.98 mm | 10 m/s | Completely unnoticeable |
| 1.2 mm | 9.8 m/s | Noticeable upon close inspection |
| 1.7 mm | 9.3 m/s | Extremely conspicuous |
| 2.1 mm | 9.1 m/s | Extremely conspicuous |

Ink weight: 7.7 ng, carriage movement velocity: 200 cps, drive frequency: 14.4 kHz, nozzle resolution: 180 dpi, number of ejection nozzles = 180

Under the conditions of this experiment, the occurrence of the wind ripple pattern phenomenon was visually confirmed when the spacing PGa from the paper-opposing surface 41*a* of the head 41 to the paper surface becomes 1.2 mm. It was also confirmed that the wind ripple pattern phenomenon became more conspicuous as the spacing PGa from the paper-opposing surface 41*a* of the head 41 to the surface of the paper becomes wider. Note that, it can be considered that the spacing PGa at which the occurrence of the wind ripple pattern phenomenon is confirmed is determined according to such factors as the movement velocity Vcr of the carriage 31 and the density of the nozzles #i.

Overview of the First Embodiment

Regarding the Configuration of the First Embodiment

Thus, it is conceived that the wind ripple pattern phenomenon is produced by the satellite ink droplets Is being carried away by the turbulence of the crosswind Ws. Here, the satellite ink droplet Is is strongly affected by the viscosity resistance of air. Thus, the flight velocity of the satellite ink droplet Is becomes slower for longer flight distances of the ink droplet.

In consideration of this point, the present embodiment is configured such that a number of non-ejection nozzles, which are caused not to eject ink, of the plurality of nozzles #i sandwiched between the nozzle #1 at one end of the nozzle row 42 and the nozzle #180 at the other end are determined according to the spacing PGa between the paper-opposing surface 41*a* and the paper surface. That is, the number of non-ejection nozzles is determined corresponding to the spacing PGa. It should be noted that the number corresponding to the spacing PGa in this case includes "0". Thus, the non-ejection nozzle is not set when under conditions in which the wind ripple pattern phenomenon does not occur. A number of non-ejection nozzles is set according to the conspicuousness of the wind ripple pattern phenomenon when under conditions in which the wind ripple pattern phenomenon does occur.

With this configuration, the portions of non-ejection nozzles in the nozzle row 42 become similar to the state in which the spacing between neighboring nozzles #i is wider than in other portions of the nozzle row 42. Thus, at the time of ink ejection, the portions corresponding to non-ejection nozzles have a weaker downward wind Wv than the other portions or there occurs no downward wind Wv. In this way, the crosswind Ws becomes less easily affected by downward turbulence and flows smoothly. As a result, it is possible to prevent unexpected landing position displacement relating to the satellite ink droplets Is.

<Regarding Height Adjustments of the Head>

Figure 21A:
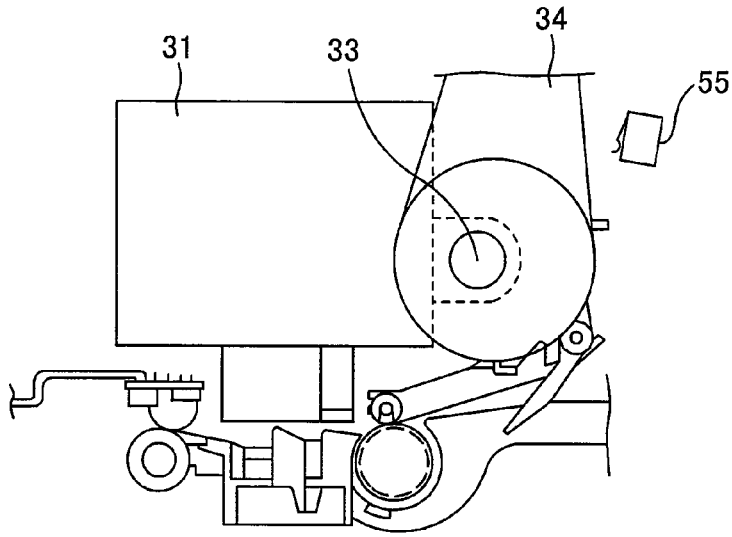
FIG. 21A is a diagram describing a state in which a paper-opposing surface of the head has approached a platen surface.
Figure 21B:
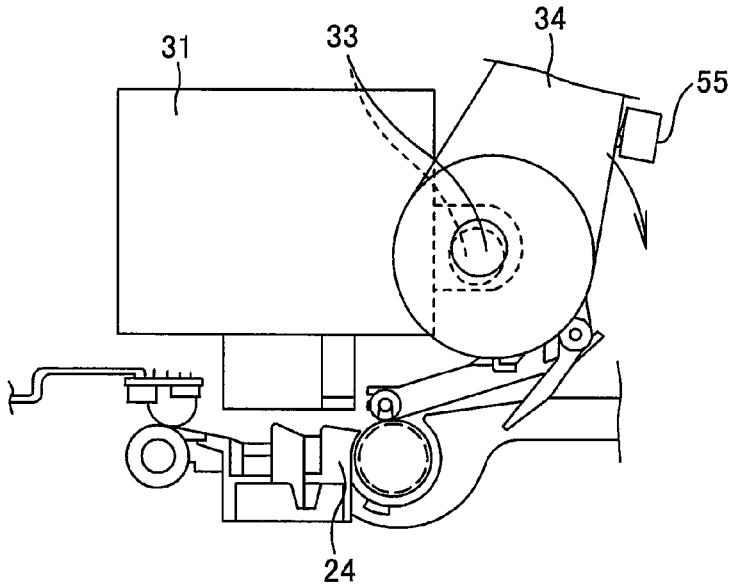
FIG. 21B is a diagram describing a state in which the paper-opposing surface of the head has moved away from the platen surface.
Figure 21C:
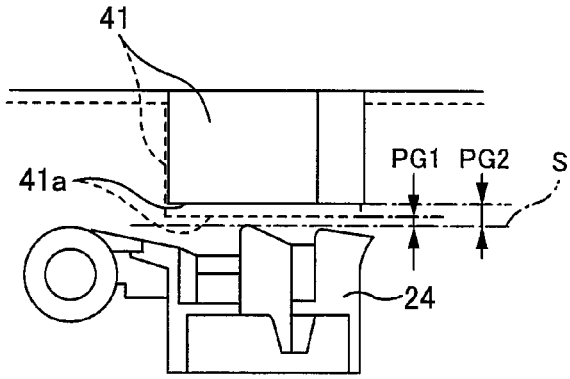
FIG. 21C is a diagram describing the differences of position relating to the paper-opposing surface of the head.

The mechanism for height adjustments of the head is described first. Here, FIGS. 21A to 21C are diagrams describing the manner in which the head 41 moves vertically due to the gap adjustment lever 34 and the guide shaft 33. Namely, FIG. 21A is a diagram describing a state in which the paper-opposing surface 41*a* of the head 41 has approached the platen surface. FIG. 21B is a diagram describing a state in which the paper-opposing surface 41*a* of the head 41 has moved away from the platen surface. FIG. 21C is a diagram describing the differences of position regarding the paper-opposing surface 41*a* of the head 41.

As shown in FIG. 21A, the paper-opposing surface 41*a* of the head 41 is closest to the platen surface when the gap adjustment lever 34 is oriented substantially vertically. That is, the head 41 is positioned in a lowered position. When the head 41 is in the lowered position, a spacing PG1 from the paper-opposing surface 41*a* of the head 41 to the platen surface is 1.5 mm, for example. As shown in FIG. 21B, when the gap adjustment lever 34 inclines to the upstream side of the paper carrying direction (the right side in the drawing), the guide shaft 33 is raised by 0.5 mm, for example. For this reason, the paper-opposing surface 41*a* of the head 41 is also raised. That is, as shown in FIG. 21C, the head 41 moves from the lowered position indicated by the dashed line to the raised position indicated by the solid line. In the raised position, a spacing PG2 from the paper-opposing surface 41*a* of the head 41 to platen surface is 2.0 mm, for example. When the paper-opposing surface 41*a* of the head 41 is in the raised position, that is, when the gap adjustment lever 34 is inclined, the head position detection sensor 55 goes ON and a detection signal is output. The head position detection sensor 55 in this example is structured using a microswitch and goes into an ON state when the gap adjustment lever 34 makes contact.

In this way, in the present embodiment, the height of the head 41 can be switched between two stages of high and low. When the height of the head 41 is "high", that is, when the head 41 is positioned in the raised position, an ON signal from the head position detection sensor 55 is input to the controller 60. For this reason, the controller 60 can recognize the height of the head 41 by monitoring the detection signal from the head position detection sensor 55.

For example, as shown in FIG. 22, in the memory 63 (see FIG. 4) of the printer 1 is stored a table of information indicating the relationship of the state of the head position detection sensor 55 according to the detection signal, the position in the height direction of the head 41, and the spacing from the paper-opposing surface 41*a* to the platen surface.

The controller 60 recognizes the height of the head 41 by referencing this table of information. Further, based on information of the height of the head 41 that has been recognized, the controller 60 obtains the spacing from the paper-opposing surface 41*a* of the head 41 to the platen surface. The obtained spacing from the paper-opposing surface 41*a* of the head 41 to the platen surface is sent to the printer driver 116.

<Regarding Recognition of Paper Thickness and Spacing from Paper-Opposing Surface to Paper Surface>

The controller 60 also obtains information of the paper thickness based on information of paper type that is input via the user interface of the printer driver 116.

For example, as shown in FIG. 23, a table of information indicating the relationship between paper type and paper thickness is stored in the memory 63 of the printer 1. Further, the controller 60 obtains information of the thickness of the paper S from information of paper type that has been input by referencing this table of information. The information of paper type is used for other purposes such as print mode settings. By using this information as information of the thickness of the paper S, it is possible to lessen the number of information items to be input, thus improving operability.

The information of the thickness of the paper S that is obtained is also sent to the printer driver 116.

<Regarding Recognition of Ejection Frequency of Ink Droplets>

The controller 60 also obtains information of the print mode based on information of image quality that is input via the user interface of the printer driver 116. For example, as shown in FIG. 24, a table of information indicating the relationship between image quality and print mode is stored in the memory 63 of the printer 1. The ejection frequency of ink droplets and the carriage movement velocity are determined according to the print mode as shown in FIG. 24.

For example, when the image quality is "normal", the print mode is set as "high speed". In the "high speed" print mode, the ejection frequency of ink droplets is set "high". In this case, the ejection frequency of ink droplets is 14.4 kHz, for example. Furthermore, the carriage movement velocity is set to "high speed". The movement velocity in this case is 76.2 cm/sec (300 cps), for example.

On the other hand, when the image quality is "fine", the print mode is set as "high image quality". In the "high image quality" print mode, the ejection frequency of ink droplets is set "low". In this case, the ejection frequency of ink droplets is 7.2 kHz, for example. Furthermore, the carriage movement velocity is set to "low speed". The movement velocity in this case is 50.8 cm/sec (200 cps), for example.

The ejection frequency of ink droplets exerts an influence on the strength of the downward wind Wv. That is, the higher the ejection frequency of ink droplets becomes, the stronger the downward wind Wv becomes. Thus, the likeliness of occurrence of wind ripple pattern phenomenon varies according to the ejection frequency of ink droplets.

<Regarding Control to Suppress Wind Ripple Pattern Phenomenon>

The printer driver 116 functions as an "ejection control section". Specifically, the printer driver 116 is a computer program for making the computer 110 function as an "ejection control section". Accordingly, by executing the printer driver 116, the computer 110 obtains the spacing PGa from the paper-opposing surface 41*a* of the head 41 to the paper surface based on information relating to the spacing from the paper-opposing surface 41*a* of the head 41 to the platen surface and information relating to the thickness of the paper S.

Next, from the information of the spacing that has been obtained and the print mode, the printer driver 116 judges whether or not to set non-ejection nozzles. After this, based on the result of this judgment, the printer driver 116 sends pixel data that has undergone halftoning to the printer 1. This is described in detail below.

Figure 25:
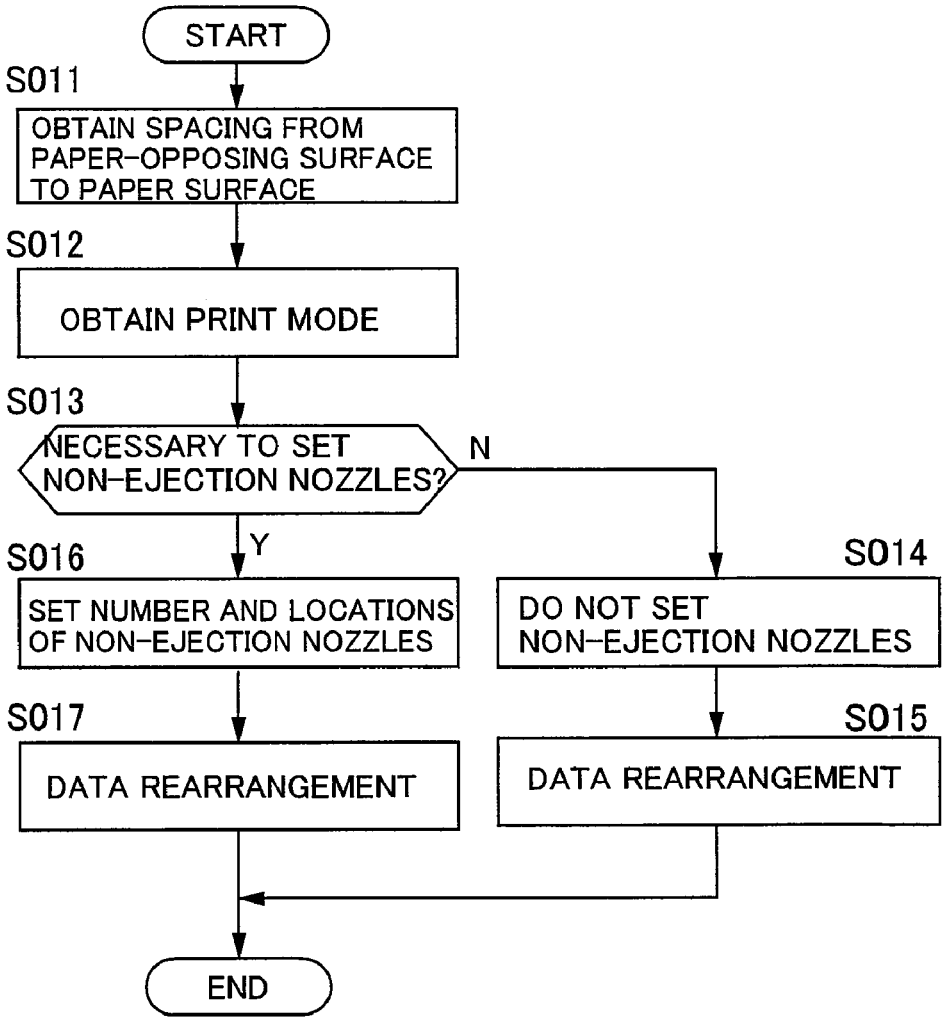
FIG. 25 is a flowchart describing each operation in a rasterization process carried out by the printer driver.

FIG. 25 is a flowchart for describing each operation in a rasterization process carried out by the printer driver 116. Accordingly, the printer driver 116 includes code for executing the various operations.

In this rasterization process, the printer driver 116 first obtains the spacing PGa from the paper-opposing surface 41*a* of the head 41 to the paper surface (S011). This operation is carried out based on information of the spacings PG1 and PG2 from the paper-opposing surface 41*a* of the head 41 to the platen surface and information of the thickness of the paper S, this information having been sent from the controller 60. For example, the printer driver 116 obtains the spacing PGa from the paper-opposing surface 41*a* of the head 41 to the paper surface by subtracting the thickness of the paper S from the spacing from the paper-opposing surface 41*a* of the head 41 to the platen surface. With this configuration, it is possible to obtain the spacing PGa without providing a dedicated measurement section. In this way a reduction in the number of components can be achieved.

Here, Table 4 is a table that shows for each type of paper S the spacing PGa from the paper-opposing surface 41*a* of the head 41 to the paper surface when the spacing from the paper-opposing surface 41*a* of the head 41 to the platen surface is 1.5 mm. Furthermore, Table 5 is a table that shows for each type of paper S the spacing PGa from the paper-opposing surface 41*a* of the head 41 to the paper surface when the spacing from the paper-opposing surface 41*a* of the head 41 to the platen surface is 2.0 mm. As shown in these tables, when the spacing PG1 from the paper-opposing surface 41*a* to the platen surface is 1.5 mm, the spacing PGa from the paper-opposing surface 41*a* of the head 41 to the paper surface is 1.5 mm or less. Further, when the spacing PG2 from the paper-opposing surface 41*a* to the platen surface is 2.0 mm, the spacing PGa from the paper-opposing surface 41*a* of the head 41 to the paper surface is 1.7 mm or more.

TABLE 4

| Paper type | Paper thickness | Paper-opposing surface to paper surface |
|---|---|---|
| Photo paper | 0.27 mm | 1.23 mm |
| Glossy paper | 0.23 mm | 1.27 mm |
| PPC paper | 0.1 mm | 1.4 mm |

Paper-opposing surface to platen surface = 1.5 mm

TABLE 5

| Paper type | Paper thickness | Paper-opposing surface to paper surface |
|---|---|---|
| Photo paper | 0.27 mm | 1.73 mm |
| Glossy paper | 0.23 mm | 1.77 mm |
| PPC paper | 0.1 mm | 1.9 mm |

Paper-opposing surface to platen surface = 2.0 mm

Once the spacing PGa from the paper-opposing surface 41*a* of the head 41 to the paper surface is obtained, the printer driver 116 obtains the print mode that has been set (S012). In the present embodiment, two kinds of print modes of "normal" and "fine" are available. Thus, the printer driver 116 obtains either the "normal" or "fine" print mode.

Once the print mode that has been set is obtained, the printer driver 116 judges whether or not to set any non-ejection nozzles (S013). The criteria for this judgment vary depending on the type of the printer 1, but the present embodiment is configured such that non-ejection nozzles are set when the spacing PGa from the paper-opposing surface 41*a* of the head 41 to the paper surface is wider than 1.5 mm, and the print mode is set to "normal". This is due to the above-described reasons. That is, the wind ripple pattern phenomenon is more prone to occur as the spacing PGa from the paper-opposing surface 41*a* of the head 41 to the paper surface becomes wider, and is more prone to occur as the movement velocities of the carriage 31 becomes faster. Moreover, the phenomenon is more prone to occur as the ejection frequency of ink droplets becomes higher. In the present embodiment, the judgment criteria are determined in consideration to these conditions. Specifically, when the print mode is set to "normal" and the head 41 is positioned in the above-described raised position, it is judged that non-ejection nozzles are to be set. No non-ejection nozzles are set when even one of these conditions is not met.

When the above-mentioned conditions are not met, that is, when the head 41 is positioned in the lowered position or when the print mode is set to "fine", non-ejection nozzles are not set (S014). In this case, it is possible for all the nozzles #i that constitute the nozzle row 42 to eject ink. In this case, in a rearrangement operation (S015), the pixel data in a number corresponding to all the nozzles #i are rearranged, and sent to the printer 1.

Figure 26A:
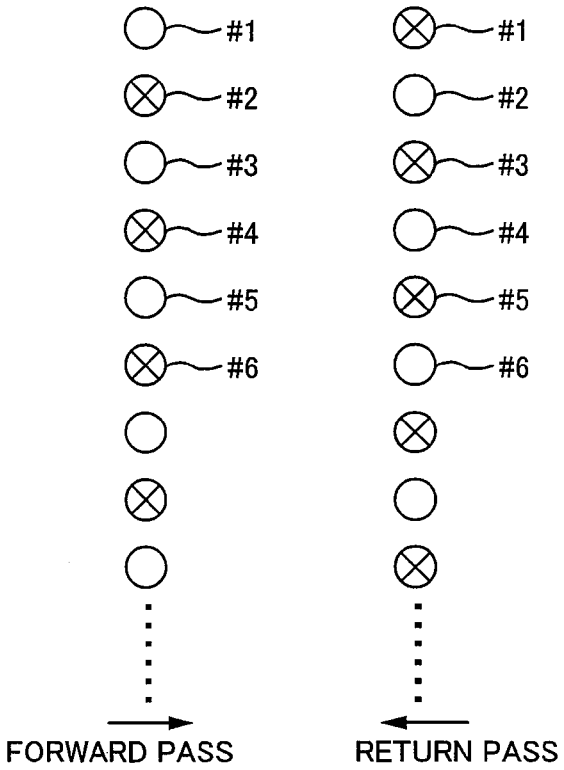
FIG. 26A is a diagram schematically showing the setting of non-ejection nozzles.
Figure 26B:
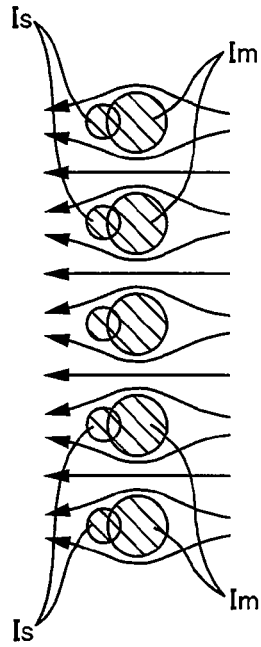
FIG. 26B is a diagram schematically showing the state of the ink droplets when the non-ejection nozzles have been set.

On the other hand, when the above-mentioned conditions are met, non-ejection nozzles are set (S016). In the present embodiment, as shown in FIG. 26A, odd number nozzles (#1, #3, #5, . . . ) are used in the forward pass of the movement of the carriage 31 and even number nozzles (#2, #4, #6, . . . ) are used in the return path. That is, every other nozzle is set as a non-ejection nozzle. By setting the non-ejection nozzles in this way, as shown in FIG. 26B, the formation pitch of the nozzles #i becomes equivalent to a state which is twice as wide. Due to this, the crosswind Ws flows through the portions corresponding to non-ejection nozzles during the above-described dot formation process. This prevents turbulence of the air flow relating to the crosswind Ws and makes it possible to prevent unexpected landing position displacement of the satellite droplets.

<Regarding the Setting of Non-Ejection Nozzles>

Incidentally, in the above-described operation of setting non-ejection nozzles (S016), every other nozzle was set as a non-ejection nozzle, but when many non-ejection nozzles are set, the printing speed is reduced accordingly, and therefore it is preferable to set as few non-ejection nozzles as possible. That is, it is preferable to set a minimum number of nozzles at which the wind ripple pattern phenomenon does not occur for every predetermined number of nozzles. Accordingly, the conditions of occurrences of unexpected satellite position displacements (the wind ripple pattern phenomenon) when the proportion of non-ejection nozzles that are set are varied, were confirmed in experiments. The confirmed results are shown in Table 6.

TABLE 6

| Duty | Satellite position displacement |
|---|---|
| 50% | Completely unnoticeable |
| 75% | Completely unnoticeable |
| 90% | Noticeable upon close inspection |
| 95% | Conspicuous |

Ink weight: 7.7 ng, carriage movement velocity: 200 cps, flight velocity of main ink droplets: 9.0 m/s, spacing between nozzle surface and paper surface: 1.7 mm, drive frequency: 14.4 kHz, nozzle resolution = 180 dpi "Duty" in Table 6 indicates the proportion of non-ejection nozzles with respect to the number of nozzles #i constituting the nozzle row 42. In the present embodiment, a single nozzle row 42 has 180 nozzles #i, and therefore a duty of 95% means that 95% of the nozzles #i of the 180 nozzles are used to eject liquid. In this case, 171 nozzles are to be used to eject ink.

With the printer 1 of the present embodiment, it is confirmed in Table 6 that it is possible to reliably prevent occurrences of the wind ripple pattern phenomenon by setting the number of non-ejection nozzles to a duty of 75%. That is, with respect to three nozzles #i, it is sufficient to set one non-used nozzle. In this case, it is preferable that the non-ejection nozzles are spaced equally, in other words, that non-ejection nozzles are set for each predetermined number of nozzles. This is because the areas in which the downward wind Wv is weak, or the areas in which this wind is not produced, are created at each constant interval. In other words, this is because the areas in which the crosswind Ws passes are formed at each constant interval. In this way, it is possible to effectively use all the plurality of nozzles of the nozzle row 42.

Further still, it is preferable that the number of non-ejection nozzles is set corresponding to the spacing PGa from the paper-opposing surface 41*a* to the paper surface. This is because the number of non-ejection nozzles required varies according to the spacing PGa. In this case, it is preferable that a mechanism for adjusting the height of the head 41 is a mechanism which can adjust the height of the head 41 to a plurality of levels. For example, instead of the gap adjustment lever 34, a structure is preferable in which a gear with the guide shaft 33 attached in an eccentric state is provided, and the gear is rotated by a drive source such as a step motor which can control the rotation amount and direction. By using such a configuration, it is possible to keep the number of non-ejection nozzles at a minimum, such that it is possible to achieve both a high level of improved print speed and prevention of the wind ripple pattern phenomenon.

Figure 27:
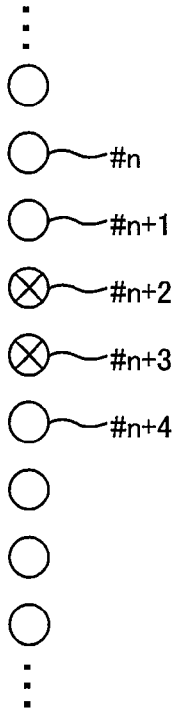
FIG. 27 is a diagram showing a plurality of the consecutive non-ejection nozzles.

Furthermore, as shown in an example in FIG. 27, the non-ejection nozzles may be set as a plurality of consecutive nozzles #i. By using such a configuration, it is possible to adjust the width of the areas through which the crosswind Ws passes. As a result, it is possible to achieve an optimal arrangement of non-ejection nozzles for the printer 1. A configuration is preferable in which the number of non-ejection nozzles is determined according to the number of the ejection nozzles #i sandwiched by non-ejection nozzles. This is because it is possible to adapt the width regarding the areas through which the crosswind Ws passes to the number of nozzles #i that can eject ink. As a result, optimization of the non-ejection nozzles can be achieved. Furthermore, the number of non-ejection nozzles can be set according to the ejection frequency of ink droplets. By doing this, it is possible to optimize the width of the areas through which the crosswind Ws passes according to the strength of the downward wind Wv, and thus it is possible to certainly prevent occurrences of the wind ripple pattern phenomenon.

Second Embodiment

Overview of the Second Embodiment

A second embodiment is described next. First, an overview of the second embodiment is described. In the second embodiment, the printer driver 116 (specifically, the computer 110 on which the printer driver 116 is executed) obtains the spacing PGa from the paper-opposing surface 41*a* of the head 41 to the paper surface based on information related to the spacing from the paper-opposing surface 41*a* of the head 41 to the platen surface and information related to the thickness of the paper S. Next, from the information of the spacing that has been obtained and the print mode, the printer driver 116 determines the number of consecutive nozzles #i which can eject ink droplets. The printer driver 116 then determines which of the nozzles #i out of the plurality of nozzles #i constituting the nozzle row are to be set as consecutive nozzles #i which can eject ink droplets. Once these determinations have been made, the printer driver 116 sends pixel data that has undergone halftoning to the printer based on the determination results. This is described in detail below.

<Regarding a Specific Example of Control>

Figure 28:
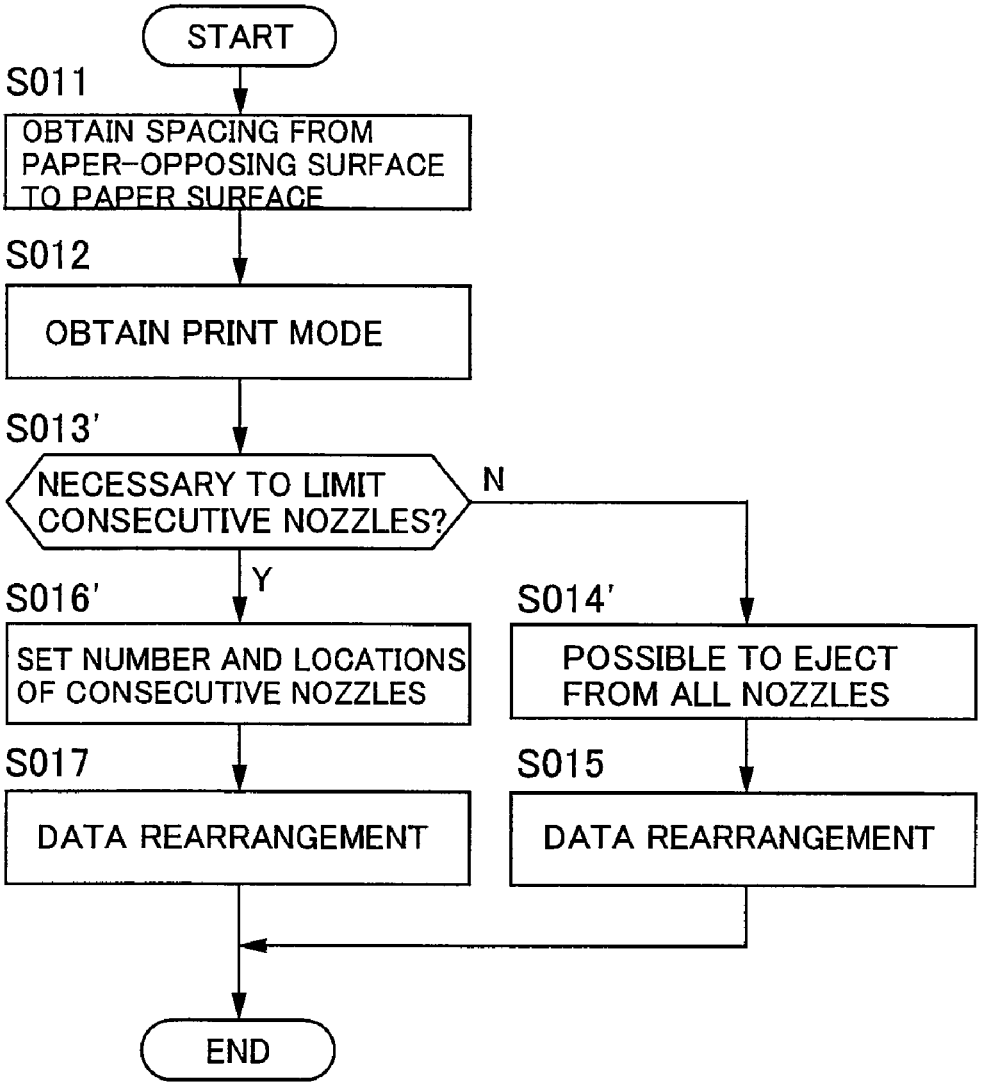
FIG. 28 is a flowchart describing each operation in another rasterization process carried out by the printer driver.

FIG. 28 is a flowchart for describing each operation in a rasterization process carried out by the printer driver 116 in the second embodiment. Accordingly, the printer driver 116 includes code for executing the various operations. In the rasterization process, the printer driver 116 first obtains the spacing PGa from the paper-opposing surface 41*a* of the head 41 to the paper surface (S011). This operation is the same as the above-described operation in the first embodiment. For example, the printer driver 116 obtains the spacing PGa from the paper-opposing surface 41*a* of the head 41 to the paper surface using a value obtained by subtracting the thickness of the paper S from the spacing from the paper-opposing surface 41*a* of the head 41 to the platen surface.

Once the spacing PGa from the paper-opposing surface 41*a* of the head 41 to the paper surface is obtained, the printer driver 116 obtains the print mode that has been set (S012). In the present embodiment, two kinds of print modes of "normal" and "fine" are available. Thus, in this step, the printer driver 116 obtains either of the "normal" or "fine" print mode.

Once the print mode that has been set is obtained, the printer driver 116 determines whether or not it is necessary to limit the number of consecutive nozzles #i which can eject ink simultaneously (S013'). The criteria for this judgment vary depending on the type of the printer 1, but in the present embodiment, it is determined that limitation is necessary when the print mode is set to "normal" and the spacing PGa from the paper-opposing surface 41*a* of the head 41 to the paper surface is 1.5 mm or more. This is due to the above-described reasons. That is, the wind ripple pattern phenomenon is more prone to occur as the spacings PGa from the paper-opposing surface 41*a* of the head 41 to the paper surface become wider, and more prone to occur as the movement velocity of the carriage 31 becomes faster. Moreover, it is more prone to occur as the ejection frequency of ink droplets becomes higher.

Consequently, as shown in FIG. 29A for example, when the print mode is set to "normal", the printer drive 116 determines that the number of consecutive nozzles #i which can eject ink droplets simultaneously is to be limited on the condition that the spacing PGa from the paper-opposing surface 41*a* of the head 41 to the paper surface is 1.5 mm or more. That is, when the head 41 is in the raised position, it is determined necessary to limit the number of nozzles #i regardless of the type of the paper S. Furthermore, when the head 41 is in the lowered position, the number of nozzles #i is not limited regardless of the type of the paper S.

When the above-described conditions are not met, the printer driver 116 determines that ink droplets can be ejected from all nozzles #i belonging to the single nozzle row (S014'). For example, when the print mode is set to "normal" and the spacing PGa from the paper-opposing surface 41*a* to the paper surface is less than 1.5 mm, as well as when the printing mode is set to "fine", the printer driver 116 determines that ink droplets can be ejected from all the nozzles #i (see FIG. 29B). In this case, in a rearrangement operation (S015), the pixel data in a number corresponding to all the nozzles #i are rearranged, and sent to the printer.

On the other hand, when the above-mentioned conditions are met, nozzles #i which can eject ink simultaneously are set (S016'). In the present embodiment, the number of consecutive nozzles #i is limited to "30". This figure is determined based on the above-described experiment results (see Table 2). That is to say, in the above-described experiment results, the wind ripple pattern phenomenon was confirmed when the number of consecutive nozzles #i was "33" or more. In consideration of this, the number of consecutive nozzles #i is to be limited to "30" in the present embodiment. By limiting the number of consecutive nozzles #i in this way, turbulence of the crosswind Ws can be prevented and it is possible to prevent unexpected landing position displacement of the satellite ink droplets Is.

Figure 30A:
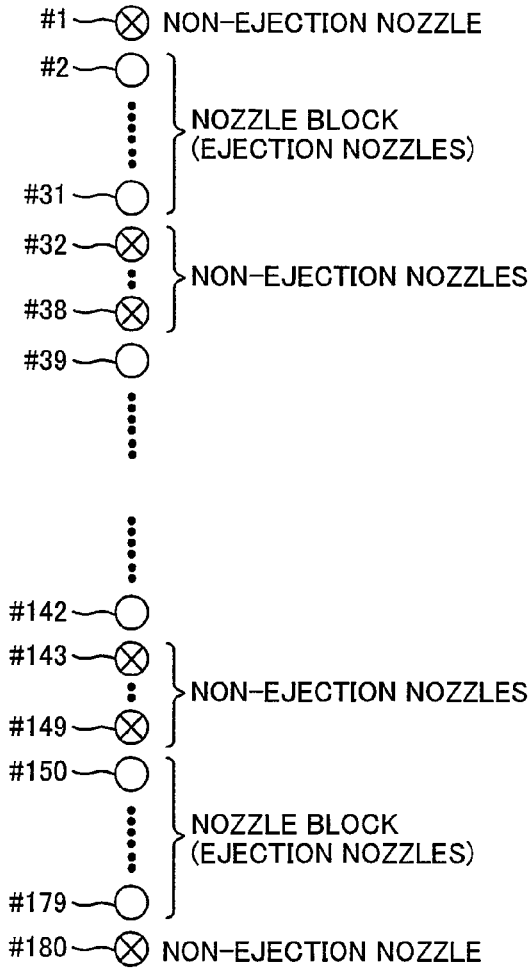
FIG. 30A is a diagram schematically showing nozzle blocks.
Figure 30B:
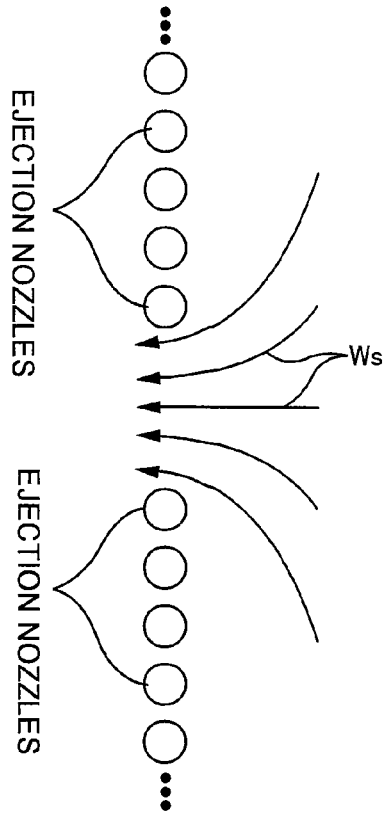
FIG. 30B is a diagram schematically showing the crosswind that flows between the nozzle blocks.

For example, as shown in FIG. 30B, the crosswind Ws that is created accompanying movement of the head 41 in the carriage movement direction goes around the sides of the downward wind Wv that is created accompanying the ejection of ink. This enables the crosswind Ws to flow smoothly and prevents turbulence thereof. In this way, it is possible to prevent unexpected landing position displacement relating to the satellite ink droplets Is.

<Regarding the Nozzle Blocks>

Further, in this embodiment, one nozzle row 42 has 180 nozzles #i. For this reason, as shown in FIG. 30A for example, within a single nozzle row 42, the printer driver 116 sets a plurality of nozzle blocks constituted by 30 of the nozzles #i which can eject ink simultaneously. In other words, of the plurality of nozzles #i lined up in a row, a plurality of consecutive nozzles #i which can eject ink simultaneously are set in a plurality of groups sandwiching the non-ejection nozzles which are caused to not eject liquid. By employing such a configuration, it is possible to effectively use all the plurality of nozzles #i constituting the nozzle row 42.

Accordingly, when a plurality of nozzle blocks are to be set within a single nozzle row 42, a configuration is preferable in which the number of non-ejection nozzles that can be set between neighboring nozzle blocks can be set according to the number of nozzles #i constituting the nozzle blocks. This is because the width of the areas through which the crosswind Ws passes is determined according to the number of non-ejection nozzles. That is, the amount of crosswind Ws that goes around the downward wind Wv is considered to be greater as the number of nozzles #i constituting the nozzle blocks increases, and it is possible to reliably prevent the wind ripple pattern phenomenon by determining the width of the areas through which the crosswind Ws passes according to the amount of the crosswind Ws.

Here, Table 7 shows the results of an experiment in which the occurrence of the wind ripple pattern phenomenon was confirmed by varying the number of non-ejection nozzles set between neighboring nozzle blocks.

TABLE 7

| Number of non-ejection nozzles between blocks (ejection nozzle numbers) | Satellite position displacement |
|---|---|
| 0 (#1 to #45) | Occurred |
| 1 (#1 to #21, #23 to #46) | Occurred |
| 2 (#1 to #21, #24 to #47) | Occurred |
| 3 (#1 to #22, #26 to #48) | Occurred |
| 4 (#1 to #22, #27 to #49) | Occurred |
| 5 (#1 to #22, #28 to #50) | No occurrence |

Ink weight: 7.7 ng, carriage movement velocity: 200 cps, flight velocity of main ink droplets: 9.0 m/s, spacing between nozzle surface and paper surface: 1.7 mm, drive frequency: 14.4 kHz, nozzle resolution: 180 dpi In the experiment shown in Table 7, one nozzle block was constituted by 21 to 22 nozzles #i. Occurrences of the wind ripple pattern phenomenon were confirmed when the number of non-ejection nozzles set between neighboring nozzle blocks was in the range of zero to four nozzles. Furthermore, it was confirmed that the wind ripple pattern phenomenon did not occur when the number of non-ejection nozzles were set at five nozzles.

It should be noted that, as shown in FIG. 30A, the number of nozzles #i constituting one nozzle block in the present embodiment is 30, and therefore the number of non-ejection nozzles is set at seven nozzles. That is, since one nozzle row 42 is constituted by 180 nozzles #1 to #180 and the non-ejection nozzles can be set between the nozzle blocks, it is possible to set up to five nozzle blocks in one nozzle row 42. Since five nozzle blocks can be set in one nozzle row 42, it is possible to set up to 30 non-ejection nozzles. Here, when there are four locations between the nozzle blocks and it is preferable for control to have equivalent spacing between the nozzle blocks, and when the number of consecutive nozzles #i is about 20, the number of non-ejection nozzles between neighboring nozzle blocks is set at seven in consideration to factors such as that the number of non-ejection nozzles is effective at five or more nozzles.

By using this configuration, the crosswind Ws whose direction has been changed by hitting the downward wind Wv is able to pass through via the areas corresponding to non-ejection nozzles between the nozzle blocks. As a result, it is possible to prevent occurrences of the wind ripple pattern phenomenon.

<Regarding the Setting of Consecutive Nozzles>

In the above-described operations (S013' and S016') of setting consecutive nozzles #i, when the print mode was set to "normal" and the head 41 was in the raised position, it was determined as necessary to limit the number of consecutive nozzles #i which can eject ink. However, since non-ejection nozzles are set when implementing this limitation, the printing speed is reduced by a corresponding amount. For this reason, it is preferable that the number of non-ejection nozzles is as small as possible. In other words, it is preferable that the number of consecutive nozzles #i is as large as possible.

In consideration of this, it is preferable that the number of consecutive nozzles #i is set smaller as the spacings PGa from the paper-opposing surface 41*a* of the head 41 to the paper surface become wider. For example, as shown in FIG. 31, when the print mode is set to "normal", a configuration is preferable in which the number of nozzles #i which can eject ink simultaneously is made smaller as spacings become wider, such that when the spacing PGa from the paper-opposing surface 41*a* to the paper surface is less than 1.0 mm there is "no limit", when 1.0 mm or more but 1.5 mm or less there is a limit of "85", and when 1.5 mm or more there is a limit of "30". By using this configuration, it is possible to set the consecutive nozzles #i which can eject ink simultaneously to a number suitable for the spacing PGa from the paper-opposing surface 41*a* of the head 41 to the paper surface. It is therefore possible to achieve high levels of both improved printing speeds and prevention of the wind ripple pattern phenomenon.

Furthermore, as mentioned above, the likeliness of occurrences of the wind ripple pattern phenomenon also varies depending on the ejection frequency of ink droplets. For this reason, it is also possible to set the number of consecutive nozzles #i which can eject ink simultaneously according to the spacing PGa from the paper-opposing surface 41*a* of the head 41 to the paper surface and the ejection frequency of ink droplets. Here, description will be given using an example of a printer 1 that can switch between three stages of ink ejection frequencies, namely low frequency (7.7 kHz), medium frequency (14.4 kHz), and high frequency (28.8 kHz) as shown in FIG. 32. With this printer 1, when the ejection frequency is low frequency, there is no limitation regarding the number of consecutive nozzles #i, regardless of the spacing PGa from the paper-opposing surface 41*a* to the paper surface. Furthermore, when the ejection frequency is medium frequency, the number of consecutive nozzles #i is limited to "85" when the spacing PGa from the paper-opposing surface 41*a* to the paper surface is 1.0 mm or more but less than 1.5 mm, and the number of consecutive nozzles #i is limited to "55" when the spacing PGa is 1.5 mm or more. Further still, when the ejection frequency is high frequency, the number of consecutive nozzles #i is limited to "55" when the spacing PGa from the paper-opposing surface 41*a* to the paper surface is 1.0 mm or more but 1.5 mm or less, and the number of consecutive nozzles #i is limited to "30" when the spacing PGa is 1.5 mm or more.

Then, in this example, it is possible to set the consecutive nozzles #i which can eject ink simultaneously to a number suitable for the strength of the air flow toward the paper. In this way, it is possible to reliably prevent unexpected landing position displacement regarding the satellite ink droplets Is, which is more conspicuous the stronger the air flows in the direction toward the paper. As a result, it is possible to achieve high levels of both improved printing speeds and prevention of the wind ripple pattern phenomenon.

<Regarding the Setting of Non-Ejection Nozzles>

Incidentally, in the above-described operations (S013' and S016') of setting consecutive nozzles #i, it is also possible to set the number of consecutive non-ejection nozzles according to the number of consecutive nozzles #i and the spacing PGa from the paper-opposing surface 41*a* of the head 41 to the paper surface. This is because, as in the above-described modified example, the likeliness of occurrences of the wind ripple pattern phenomenon varies according to the spacing PGa from the paper-opposing surface 41*a* to the paper surface. For example, the number of non-ejection nozzles becomes smaller the narrower the spacings PGa from the paper-opposing surface 41*a* to the paper surface. In this case, the number of non-ejection nozzles is set according to the number consecutive nozzles #i which can eject ink simultaneously. Thus, the number of non-ejection nozzles when the spacing PGa from the paper-opposing surface 41*a* of the head 41 to the paper surface is 1.5 mm or more is used as a reference number, and when this spacing becomes 1.0 mm or more but 1.5 mm or less, it is preferable to calculate the number of non-ejection nozzles by multiplying the reference number by a predetermined coefficient (a value greater than zero and less than 1). In the example shown in FIG. 33, "0.5" is the predetermined coefficient. Thus, when the reference number relating to non-ejection nozzles is "10", then the number of non-ejection nozzles is "5" when the spacing PGa from the paper-opposing surface 41*a* to the paper surface is 1.0 mm or more but 1.5 mm or less. It should be noted that, in this example, no non-ejection nozzles are set when the spacing PGa from the paper-opposing surface 41*a* to the paper surface is less than 1.0 mm. Thus, the predetermined coefficient is not set.

By using this configuration, the width of the areas through which the crosswind Ws passes can be optimized according to how easy it is for the satellite ink droplets Is to land.

Other Embodiments

Regarding the Setting of Non-Ejection Nozzles

It should be noted that in the foregoing embodiments, settings for the nozzles #i which can eject ink and the like were carried out by the printer driver 116, but it is also possible for the controller 60 of the printer 1 to carry out the above instead.

<Regarding the Printer>

In the above embodiments the printer 1 was described, however, there is no limitation to this. For example, technology similar to that of the present embodiments can also be adopted for various types of recording apparatuses that apply inkjet technology, including, for example, color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, these methods and manufacturing methods are within the scope of application.

<Regarding the Ink>

The above embodiments were embodiments of the printer 1, and thus dye ink or pigment ink was ejected from the nozzles #i. However, the ink that is ejected from the nozzles #i is not limited to such inks.

<Regarding the Nozzles>

In the foregoing embodiments, ink was ejected using the piezoelectric elements PZT. However, the mode for ejecting ink is not limited to this. Other methods, such as a method for generating bubbles in the nozzles by heat, can also be employed.

<Regarding the Nozzle Rows Used in Printing>

In the foregoing embodiment, it was possible to eject of the different colors respectively from eight nozzle rows 42, but there is no limitation to this. The nozzle rows 42 can be constituted by four rows or six rows, or can be constituted by two rows.

<Regarding the Section for Setting Spacings>

In the foregoing embodiments, description was given using an example of the printer 1 in which the spacing between the paper-opposing surface 41*a* of the head 41 and the platen surface was set by vertically moving the head 41, but there is no limitation to the printer 1. For example, it is also possible to vertically move the platen 24.

What is claimed is:

1. A liquid jetting apparatus comprising:

a head in which a plurality of nozzles lined up in a row are provided in a medium-opposing surface which is in opposition to a medium, a head movement section that moves said head in a predetermined direction along a surface of said medium, a spacing adjustment section that adjusts a spacing between said head and said medium, and an ejection control section that carries out ejection control of a liquid by limiting the number of consecutive nozzles which are allowed to eject the liquid simultaneously according to a spacing from said medium-opposing surface to the surface of said medium;

wherein said ejection control section makes the number of said consecutive nozzles smaller as said spacing from said medium-opposing surface to the surface of said medium becomes wider.

2. A liquid jetting apparatus according to claim 1, further comprising a medium placing section on which said medium is placed, wherein said ejection control section obtains said spacing from said medium-opposing surface to the surface of said medium based on information relating to a spacing from a surface of said medium placing section to said medium-opposing surface, and information relating to a thickness of said medium.

3. A liquid jetting apparatus according to claim 2, wherein said spacing adjustment section is another head movement section that moves said head in a direction approaching said medium and in a direction away from said medium, and wherein said information relating to the spacing from the surface of said medium placing section to said medium-opposing surface is information indicating a position of said head determined using said other head movement section.

4. A liquid jetting apparatus according to claim 2, wherein said information relating to the thickness of said medium is information indicating a type of said medium.

5. A liquid jetting method comprising:

obtaining a spacing from a medium-opposing surface of a head to a surface of a medium, wherein a plurality of nozzles lined up in a row are provided in said medium-opposing surface, limiting the number of consecutive nozzles which are allowed to eject a liquid simultaneously according to said spacing from said medium-opposing surface to the surface of said medium, and ejecting the liquid using at least a portion of said limited number of nozzles while moving said head in a predetermined direction along the surface of said medium;

wherein said limiting makes the number of said consecutive nozzles smaller as said spacing from said medium-opposing surface to the surface of said medium becomes wider.

* * * * *